US011419412B1

(12) United States Patent
Chen

(10) Patent No.: US 11,419,412 B1
(45) Date of Patent: Aug. 23, 2022

(54) COMBINED TYPE SHELF

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 17/399,100

(22) Filed: Aug. 11, 2021

(30) Foreign Application Priority Data

May 13, 2021 (TW) ..... 110117191

(51) Int. Cl.

| | |
|---|---|
| ***A47B 47/00*** | (2006.01) |
| ***A47B 57/00*** | (2006.01) |
| ***A47B 55/00*** | (2006.01) |
| ***A47B 55/02*** | (2006.01) |
| ***A47B 88/407*** | (2017.01) |
| ***A47B 96/14*** | (2006.01) |
| ***A47B 57/54*** | (2006.01) |
| ***A47B 87/02*** | (2006.01) |
| ***A47B 87/00*** | (2006.01) |
| ***A47B 57/12*** | (2006.01) |
| ***A47F 5/13*** | (2006.01) |
| ***A47F 5/01*** | (2006.01) |

(52) U.S. Cl.

CPC ..... *A47B 47/00* (2013.01); *A47B 47/0083* (2013.01); *A47B 57/12* (2013.01); *A47B 57/545* (2013.01); *A47B 87/001* (2013.01); *A47B 87/02* (2013.01); *A47B 88/407* (2017.01); *A47B 96/1441* (2013.01); *A47F 5/01* (2013.01); *A47F 5/13* (2013.01); *A47B 55/02* (2013.01)

(58) Field of Classification Search

CPC ... A47B 47/00; A47B 47/0083; A47B 47/024; A47B 57/12; A47B 57/54; A47B 57/545; A47B 88/407; A47B 96/06; A47B 96/1441; A47B 87/001; A47B 87/021; A47B 55/02; A47F 5/13; A47F 5/01

See application file for complete search history.

(56) References Cited

U.S. PATENT DOCUMENTS

| | | | | | |
|---|---|---|---|---|---|
| 2,894,643 | A * | 7/1959 | Maslow | ..... | A47B 55/02 211/189 |
| 2,919,816 | A * | 1/1960 | Maslow | ..... | A47B 55/02 403/217 |
| 2,970,702 | A * | 2/1961 | Maslow | ..... | A47B 55/02 108/106 |
| 3,316,864 | A * | 5/1967 | Maslow | ..... | A47B 57/54 211/186 |
| 3,898,939 | A * | 8/1975 | Grachten | ..... | A47B 47/0091 248/245 |

(Continued)

*Primary Examiner* — Kimberley S Wright
(74) *Attorney, Agent, or Firm* — WPAT, PC

(57) ABSTRACT

A combined type shelf includes parallel-rod side frames, inter-frame connectors, storage layers and horizontal constraint frames. The parallel-rod side frame includes a first vertical bar, a second vertical bar and a horizontal bar. The inter-frame connector includes a connector body, two lateral plates, a hole and lower interference parts. The storage layer is disposed between two horizontal constraint frames. The horizontal constraint frame includes a horizontal stop member and a constraint-frame coupling member. The constraint-frame coupling member includes upper interference parts to buckle the lower interference parts so as to connect the horizontal constraint frame to the inter-frame connector.

10 Claims, 24 Drawing Sheets

(56) References Cited

U.S. PATENT DOCUMENTS

| | | | | | |
|---|---|---|---|---|---|
| 4,079,678 | A * | 3/1978 | Champagne | A47B 57/545 | 108/106 |
| 4,592,286 | A * | 6/1986 | Trubiano | A47B 57/545 | 211/208 |
| 5,027,959 | A * | 7/1991 | Luukkonen | A47B 47/021 | 211/186 |
| 5,221,014 | A * | 6/1993 | Welch | A47F 5/13 | 211/187 |
| 5,833,084 | A * | 11/1998 | Chang | A47B 55/02 | 211/90.03 |
| 8,651,300 | B2 * | 2/2014 | Chen | A47B 47/024 | 211/187 |
| 9,307,833 | B2 * | 4/2016 | Rosen | A47F 5/01 | |
| 9,585,469 | B2 * | 3/2017 | Huang | A47B 47/021 | |
| 10,980,344 | B1 * | 4/2021 | Yang | A47B 96/1466 | |
| 2001/0006163 | A1 * | 7/2001 | Scudeller | A46B 17/02 | 211/182 |
| 2007/0108147 | A1 * | 5/2007 | Chen | A47B 47/00 | 211/187 |
| 2011/0220602 | A1 * | 9/2011 | Chen | A47B 87/001 | 248/250 |
| 2012/0298606 | A1 * | 11/2012 | Chen | A47B 57/265 | 211/186 |
| 2012/0298607 | A1 * | 11/2012 | Chen | A47B 57/265 | 211/186 |
| 2015/0069000 | A1 * | 3/2015 | Rosen | A47F 5/01 | 211/186 |

* cited by examiner

COMBINED TYPE SHELF

CROSS REFERENCE TO RELATED APPLICATION

This application claims the benefits of Taiwan application Serial No. 110117191, filed on May 13, 2021, the disclosures of which are incorporated by references herein in its entirety.

TECHNICAL FIELD

The present disclosure relates in general to a shelf structure, and more particularly to a combined type shelf structure.

BACKGROUND

Modular furniture becomes more and more popular due to its convenience in transportation and storage, and thus it can be widely seen in domestic, office or workplace application. Some modular furniture, such as a combined type shelf, can be randomly combined into different formulations to meet various needs in size or shape.

Traditionally, a typical combined type shelf is formed by fixing firmly pipes or racks by screws, bolts, etc. Particularly, such a combined type shelf is usually formed by two parallel-rod side frames and several parallel storage layers horizontally mounted between the two standing parallel-rod side frames. This parallel-rod side frame includes two vertical poles separated by a predetermined distance and at least two horizontal iron wires arranged between the two vertical poles by welding or some other fixation means. Each of the storage layers can be fixed to the horizontal iron wires by iron plate hooks on a wooden board of the storage layer, and plural crossing traction wire structures are appropriately applied to fix the entire shelf as a whole at rear sides of the two parallel-rod side frames and the storage layers. While in assembling this type of shelve, hand tools are necessary, and thus assembly and application inconvenience is inevitable.

Therefore, how to improve the aforesaid problems encountered in the art is definitely one of the issues to be solved by this industry.

SUMMARY

In order to replace the crossing traction wires for locking the horizontal storage layers between the two parallel-rod side frames, an object of the present disclosure is to provide a combined type shelf, that is simply but firmly structured without specific assembling tools. In addition, this combined type shelf of this disclosure is assembled more conveniently and flexibly.

In accordance with one aspect of this disclosure, the combined type shelf includes at least two parallel-rod side frames, a plurality of inter-frame connectors, a plurality of storage layers and a plurality of horizontal constraint frames. Each of the parallel-rod side frames includes two vertical bar assemblies and a plurality of horizontal bars, each of the horizontal bars is disposed within the corresponding vertical bar assembly, each of the vertical bar assemblies includes a first vertical bar and a second vertical bar parallel to the first vertical bar in a side-by-side manner, each of the horizontal bars has two opposite ends, and each of the two opposite ends is fixed between the first vertical bar and the second vertical bar of the corresponding vertical bar assembly. Each of the inter-frame connectors includes a connector body, two lateral plates, a hole and at least one lower interference part. The connector body has two opposite sides extending outward to form the two lateral plates. The hole is disposed at the connector body. Each of the at least one lower interference part is disposed at the corresponding lateral plates. Each of the horizontal bars penetrates the corresponding hole, such that the connector body and each of the two lateral plates surround the first vertical bar and the second vertical bar. The plurality of storage layers are disposed between two of the at least two parallel-rod side frames. Each of the storage layers is furnished with at least one horizontal constraint frame. Each of the horizontal constraint frames includes a horizontal stop member and two constraint-frame coupling members. Each of the two constraint-frame coupling members is connected with one corresponding end of the horizontal stop member. Each of the two constraint-frame coupling members includes at least one upper interference part, and each of the at least one upper interference part is buckled with the at least one lower interference part, such that each of the horizontal constraint frames can be connected with corresponding one of the inter-frame connectors.

In one embodiment of this disclosure, the combined type shelf further includes a plurality of interference plates, and each of the interference plates is connected with the corresponding horizontal stop member.

In one embodiment of this disclosure, the combined type shelf further includes a plurality of upper interference plates, and each of the upper interference plates is buckled with corresponding one of the interference plates.

In one embodiment of this disclosure, the combined type shelf further includes a plurality of locating grooves disposed among the interference plates, between each of the interference plates and the corresponding constraint-frame coupling member, or within the constraint-frame coupling member. Each of the locating grooves is used for clamping corresponding one of the at least one vertical side plate to further position each of the at least one vertical side plate on one of the storage layers.

In one embodiment of this disclosure, the at least one vertical side plate is used for constructing a drawer, a cupboard or a storage box.

In one embodiment of this disclosure, each of the two constraint-frame coupling members includes a main coupling plate, a first lateral plate and a second lateral plate. The first lateral plate and the second lateral plate are located to two opposite sides of the main coupling plate and also perpendicular to the main coupling plate so as to form thereinside the locating groove.

In one embodiment of this disclosure, each of the constraint-frame coupling members further includes a hanging slot disposed at the second lateral plate.

In one embodiment of this disclosure, each of the inter-frame connectors includes an inward protrusion disposed at the connector body by closing to the hole, and the inward protrusion used for supporting the horizontal bar is protruded from a surface of the connector body.

In one embodiment of this disclosure, the connector body includes a junction section and two pairing blocks, two opposite sides of the junction section extend outward to connect respectively the two pairing blocks, the inward protrusion and the hole are both disposed at the junction section, and each of the two pairing blocks is used for receiving the first vertical bar and the second vertical bar.

In one embodiment of this disclosure, the lower interference part is formed as an interference groove of the lateral plate.

As stated, in the combined type shelf provided by this disclosure, no assembly tool is required, and the new design at the horizontal constraint frame is introduced to pair the buckling by the lower interference parts of the inter-frame connector at the parallel-rod side frame, such that the object of assembly convenience can be achieved. Also, the horizontal constraint frame can be used to stabilize the entire structure of the combined type shelf, and thus no more crossing traction wires in the art is required.

Further, the horizontal constraint frame is provided with hanging capacity, and thereby additional functions or fittings can be added per practical requirements, such that assembling flexibility of the entire combined type shelf can be further enhanced.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
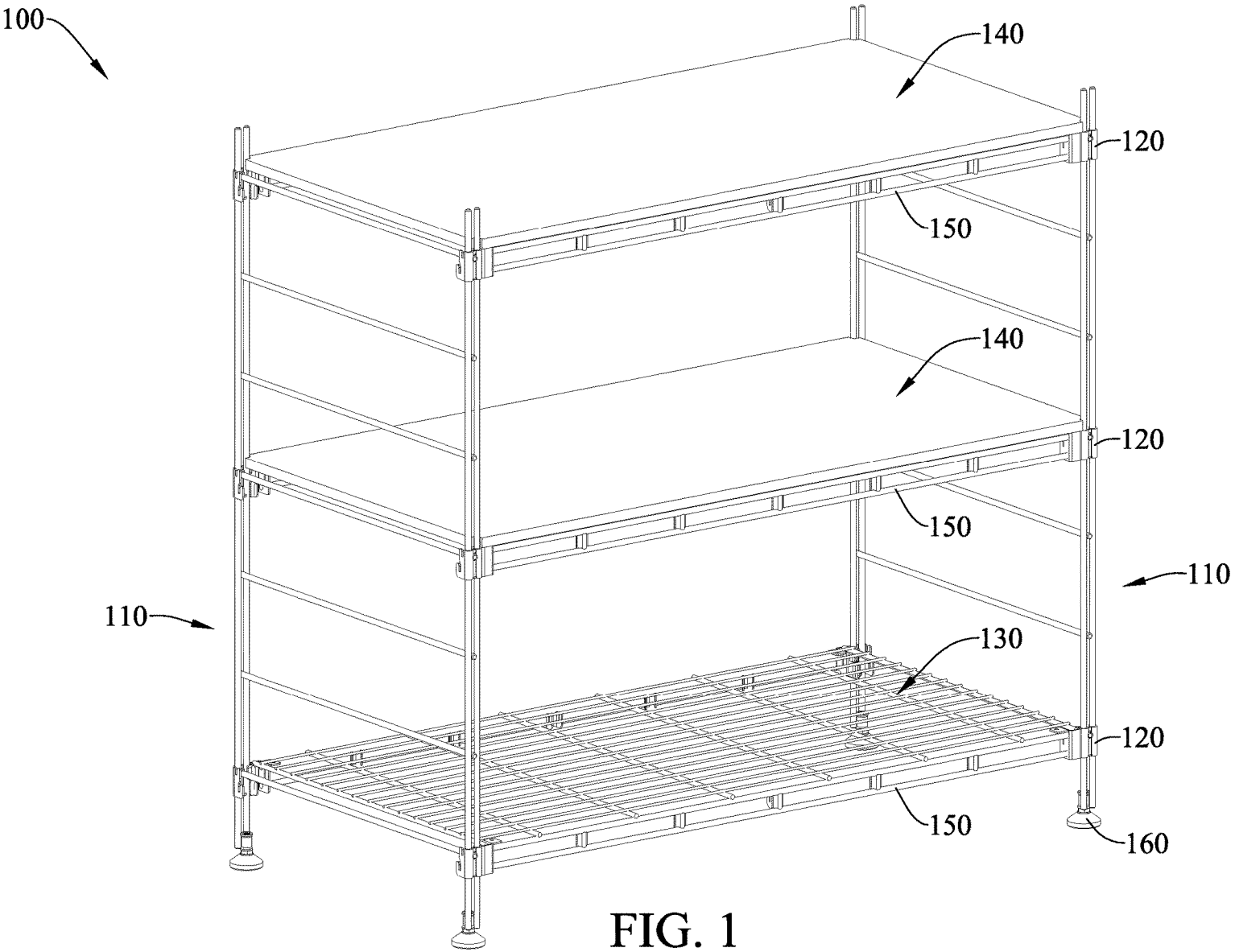
FIG. 1 is a schematic view of an embodiment of the combined type shelf in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1, a schematic view of an embodiment of the combined type shelf in accordance with this disclosure is shown. In this embodiment, the combined type shelf 100 includes two parallel-rod side frames 110, a plurality of inter-frame connectors 120, a plurality of storage layer consisted of a first storage layer 130 and two second storage layers 140, and a plurality of horizontal constraint frames 150. This combined type shelf 100 is constructed by the left parallel-rod side frame 110, the right parallel-rod side frame 110 parallel to and spaced from the left parallel-rod side frame 110 by a predetermined distance, and the three parallel storage layers mounted horizontally between the two parallel-rod side frames 110, with the two second storage layers 140 located above the first storage layer 130. In particular, the first storage layer 130 is a storage layer made up by wires, while each of the two second storage layers 140 is a flat-board storage layer. Apparently, in this embodiment, a basic structure is provided for the combined type shelf 100. With inclusion of the horizontal constraint frames 150 and the inter-frame connectors 120 for the parallel-rod side frames 110, then the object of needing no tool for assembly can be achieved. In this disclosure, the required amount of the parallel-rod side frames 110, the first storage layers 130, the second storage layers 140, the inter-frame connectors 120 and the horizontal constraint frames 150 can be determined per practical requirements. In other embodiments, standing structures 160 can be added to lower ends of the parallel-rod side frame 110, so as to enhance standing stability of the entire combined type shelf 100. In the following description, the parallel-rod side frame 110, the inter-frame connector 120, the first storage layer 130, the horizontal constraint frame 150, and the second storage layer 140 would be orderly elucidated.

Figure 3A:
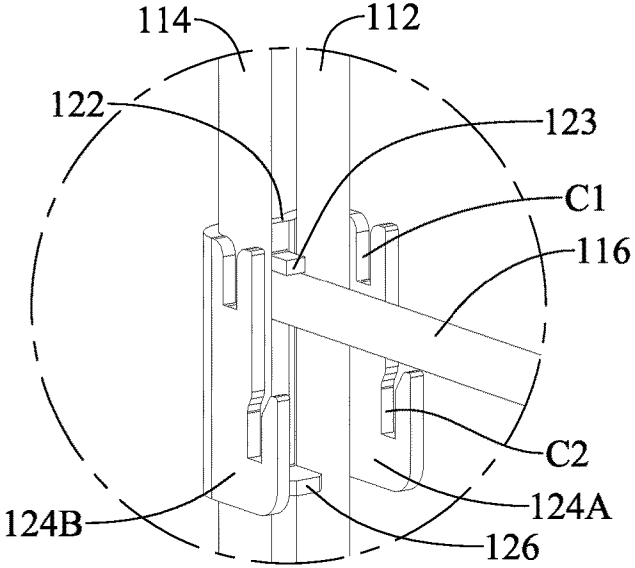
FIG. 3A is an enlarged view of Circle A2 of FIG. 2.
Figure 3B:
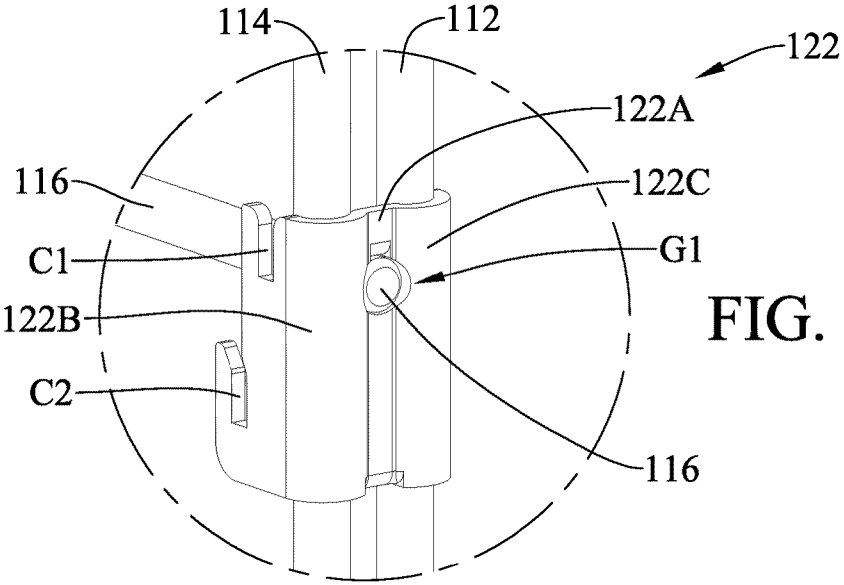
FIG. 3B is an enlarged view of Circle A3 of FIG. 2.
Figure 2:
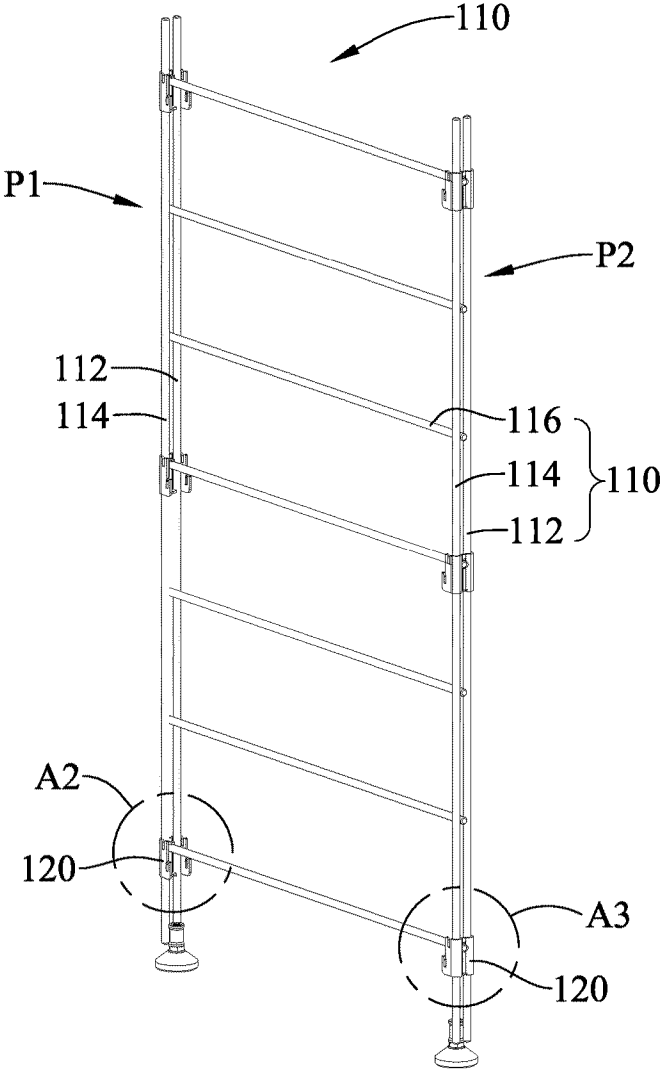
FIG. 2 shows schematically the parallel-rod side frame of FIG. 1.

FIG. 2 shows schematically the parallel-rod side frame of FIG. 1, FIG. 3A is an enlarged view of Circle A2 of FIG. 2, and FIG. 3B is an enlarged view of Circle A3 of FIG. 2. Referring to FIG. 1 through FIG. 3B. In this embodiment, each of the parallel-rod side frames 110 includes two vertical bar assemblies P1, P2 and a plurality of horizontal bars 116. These horizontal bars 116 are disposed, from top to bottom, between the two vertical bar assemblies P1, P2. Each of the vertical bar assemblies P1, P2 includes a first vertical bar 112 and a second vertical bar 114. The first vertical bar 112 and the second vertical bar 114 are arranged in parallel so as to form the vertical bar assembly P1 or the vertical bar assembly P2. Each of two opposite ends of the horizontal bar 116 is fixed between the first vertical bar 112 and the second vertical bar 114. Namely, a gap formed between the first vertical bar 112 and the second vertical bar 114 is utilized to receive the corresponding end of the horizontal bar 116.

In this embodiment, each of the inter-frame connector 120 includes a connector body 122, two lateral plates 124A, 124B and a hole G1, and each of the lateral plates 124A, 124B has two lower interference parts C1, C2. Two opposite sides of the connector body 122 are extended parallel to form respective lateral plates 124A, 124B. The hole G1 is to penetrate through the connector body 122. The two lower interference parts C1, C2 are disposed to each of the lateral plates 124A, 124B. The lateral plate 124A or 124B provides two different positions (with different heights, for example) to construct the lower interference parts C1, C2. For example, each of the lower interference parts C1, C2 is formed as an interference groove on the lateral plate 124A or 124B. The lower interference part C1 can be an interference groove formed at a top end of the corresponding lateral plate 124A or 124B, while the lower interference part C2 can be an interference groove formed between a lateral side of the lateral plate 124A or 124B and a protrusion of the lateral side. However, this disclosure is not limited thereto. Practically, the amount of the lower interference parts C1, C2 and the corresponding dispositions can be determined per practical requirements. In this embodiment, each end of the horizontal bar 116 is to penetrate through the corresponding hole G1 (as shown in FIG. 3B), such that the connector body 122 and the extended lateral plates 124A, 124B can in position to surround both the first vertical bar 112 and the second vertical bar 114. In other words, in this embodiment, the inter-frame connector 120 is applied to couple the first vertical bar 112, the second vertical bar 114 and the horizontal bar 116 together, such that the parallel-rod side frame 110 can be formed thereafter.

In addition, this disclosure does not limit the type of the inter-frame connector 120. In another embodiment, the inter-frame connector 120 can include an inward protrusion 123 protruding from an inner surface of the connector body 122.

In a further exemplary example, the connector body 122, having a U-shape appearance, can include a junction section 122A and two pairing blocks 122B, 122C. Two opposite sides of the junction section 122A are connected with the corresponding pairing blocks 122B, 122C, respectively. The inward protrusion 123 and the hole G1 are both located at the junction section 122A. Namely, the inward protrusion 123 and the hole G1 are both located between the two pairing blocks 122B, 122C. The pairing blocks 122B, 122C are used for bracing thereinside the second vertical bar 114 and the first vertical bar 112. In particular, each of the pairing blocks 122B, 122C has a concave inner wall shaped to match the shape of the corresponding first vertical bar 112 and second vertical bar 114, respectively. In addition, as shown in FIG. 3A, the inter-frame connector 120 can further include an inward protrusion 126, and the hole G1 is located between the two inward protrusions 123, 126.

Figure 4A:
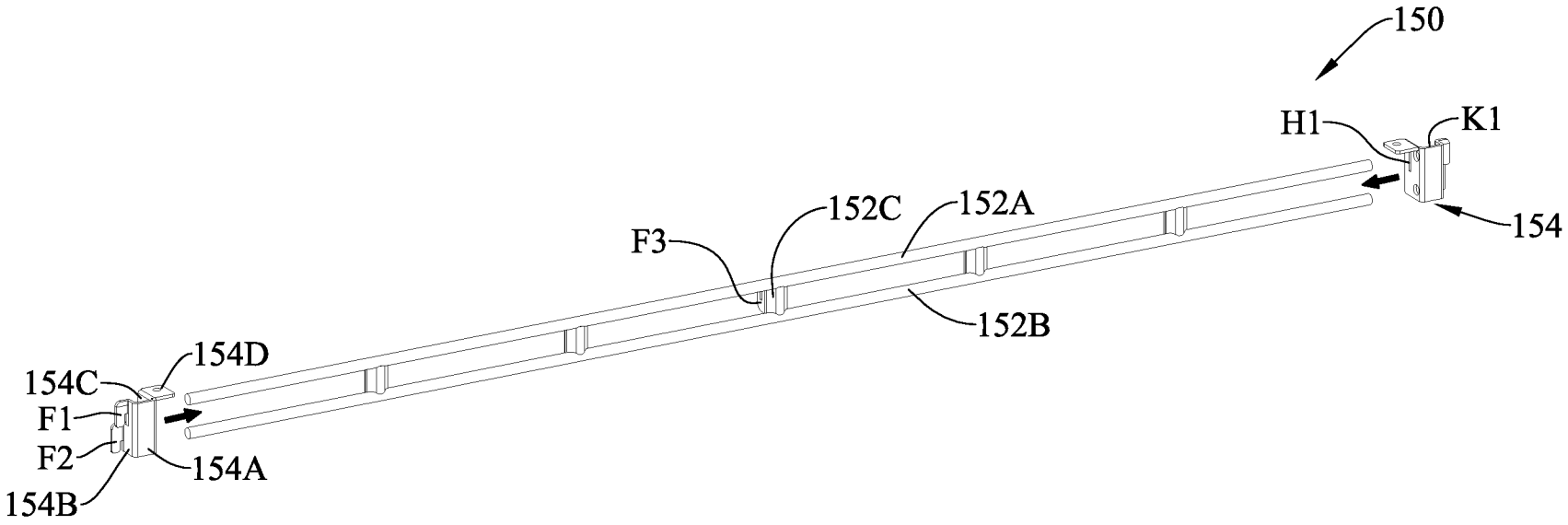
FIG. 4A is an exploded view of the horizontal constraint frame of FIG. 1.
Figure 4B:
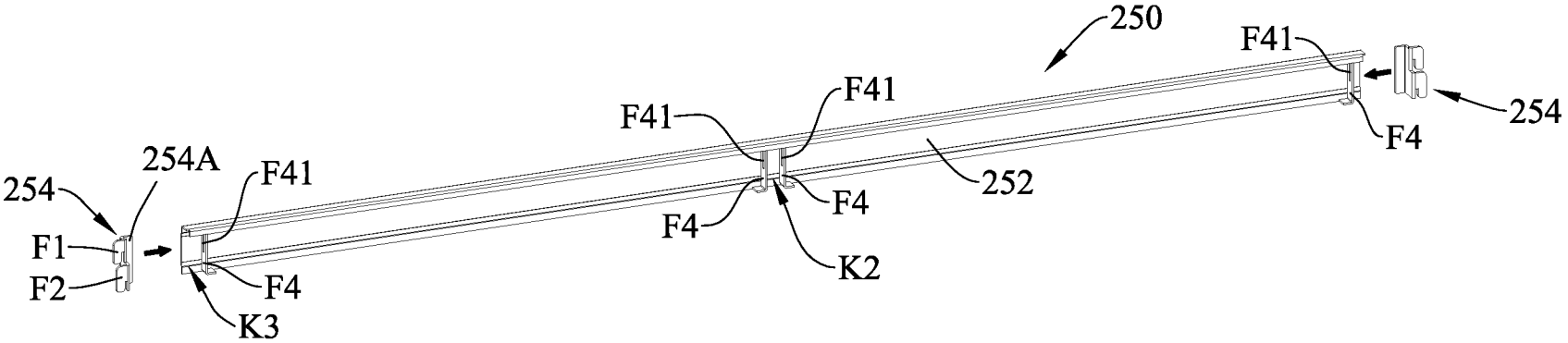
FIG. 4B demonstrates another exemplary example of the horizontal constraint frame of this disclosure in a schematic exploded view.
Figure 5A:
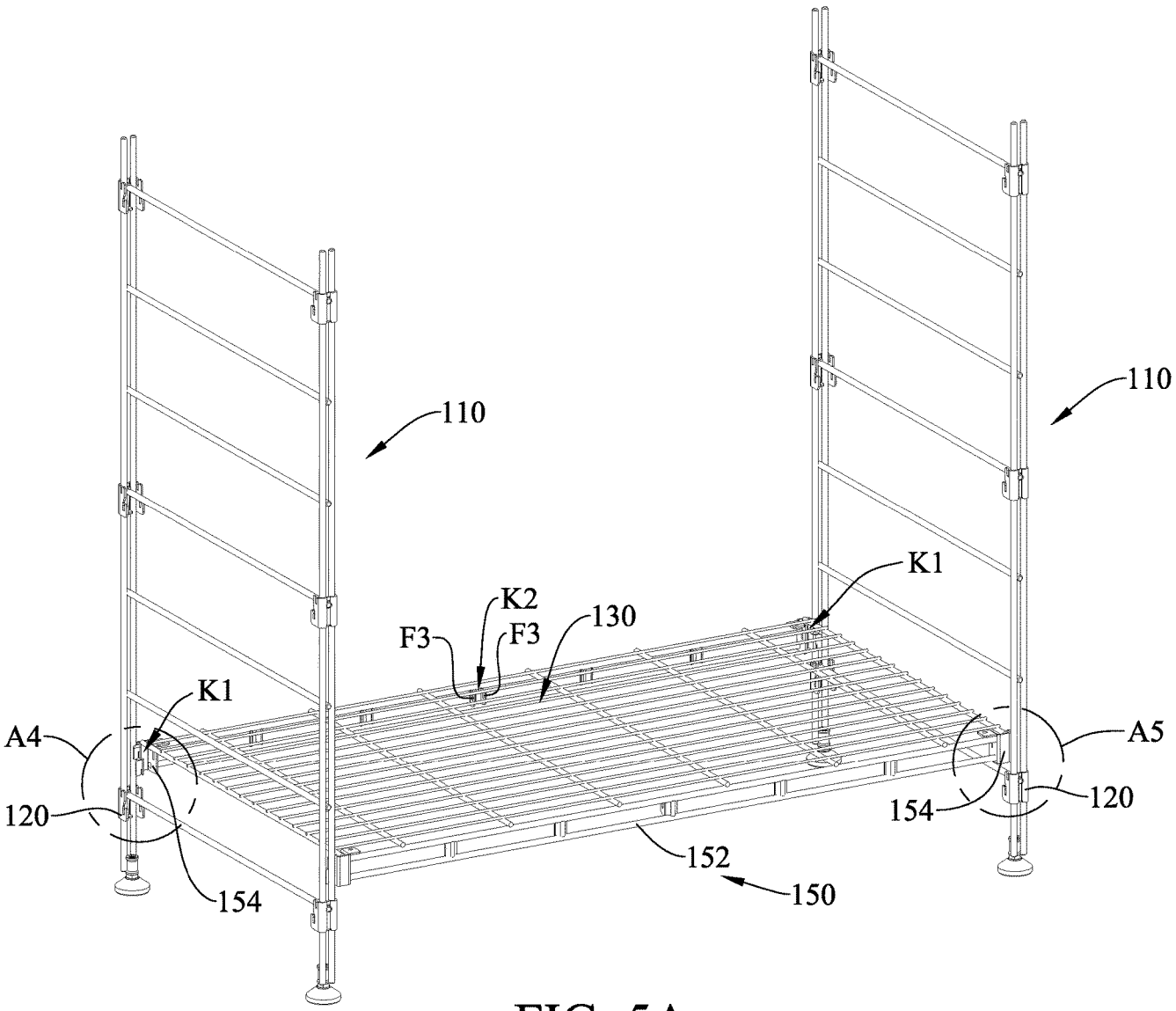
FIG. 5A shows schematically the first storage layer to be mounted between the two parallel-rod side frames of FIG. 1.
Figure 5C:
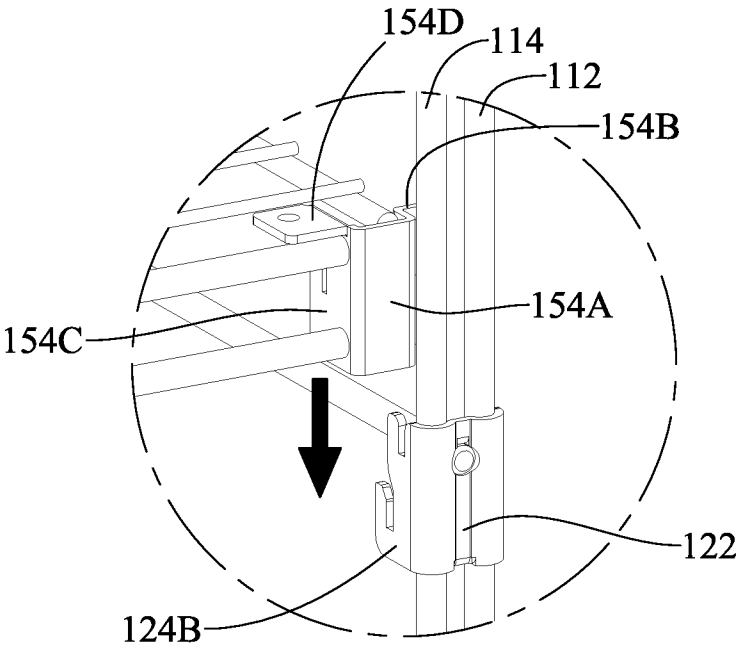
FIG. 5C is an enlarged view of Circle A5 of FIG. 5A.
Figure 5B:
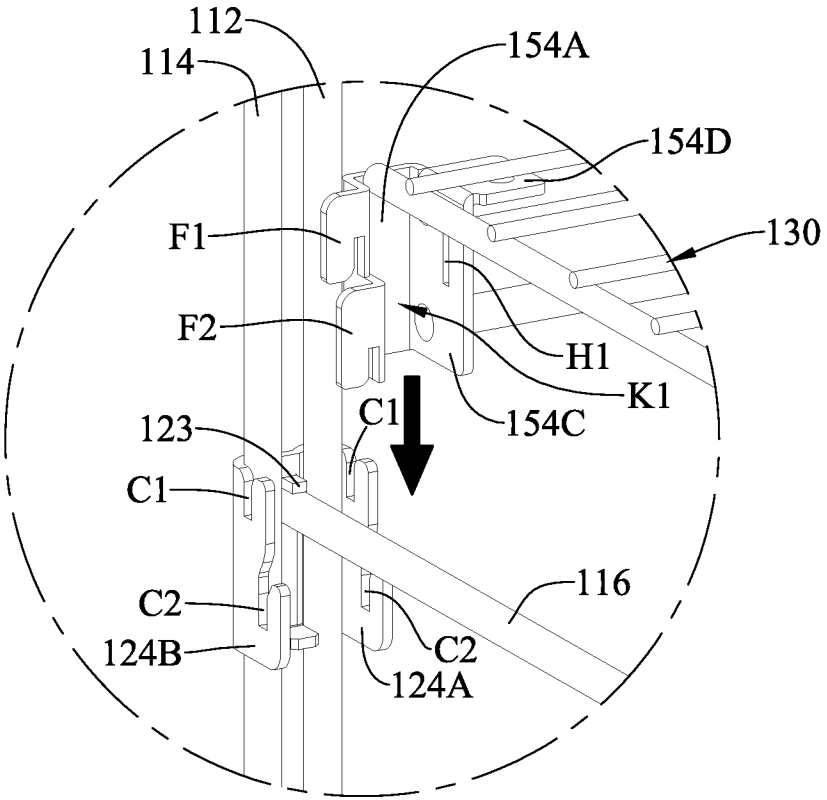
FIG. 5B is an enlarged view of Circle A4 of FIG. 5A.

FIG. 4A is an exploded view of the horizontal constraint frame of FIG. 1, FIG. 4B demonstrates another exemplary example of the horizontal constraint frame of this disclosure in a schematic exploded view, FIG. 5A shows schematically the first storage layer to be mounted between the two parallel-rod side frames of FIG. 1, FIG. 5B is an enlarged view of Circle A4 of FIG. 5A, and FIG. 5C is an enlarged view of Circle A5 of FIG. 5A. Firstly, referring to FIG. 1 and FIG. 4A, in this embodiment, two horizontal constraint frames 150 are disposed respectively to the front side and the rear side of the first storage layer 130. The horizontal constraint frame 150 includes a horizontal stop member 152 and two constraint-frame coupling members 154. Each of the two constraint-frame coupling members 154 is connected with the corresponding end of the horizontal stop member 152. Referring to FIG. 5A through FIG. 5C, in this embodiment, each of the constraint-frame coupling members 154 includes two upper interference parts F1, F2. Each of these two upper interference parts F1, F2 can be a protrusion block directing downward. As shown in FIG. 5B, the upper interference parts F1, F2 are disposed in correspondence to the lower interference parts C1, C2, such that, while the first storage layer 130 as well as the connected horizontal constraint frames 150 are lowered as shown in FIG. 5A, the upper interference parts F1, F2 can buckle the corresponding lower interference parts C1, C2, respectively, so as to have the horizontal constraint frames 150 to engage the corresponding inter-frame connectors 120. As such, the first storage layer 130 can be assembled between the two parallel-rod side frames 110. Similarly, while the second storage layer 140 and the connected horizontal constraint frames are lowered down 150 vertically, the upper interference parts F1, F2 would buckle the corresponding lower interference parts C1, C2, respectively, such that the horizontal constraint frames 150 can engage the corresponding inter-frame connectors 120, and thus the second storage layer 140 can be mounted between the two parallel-rod side frames 110.

The disclosure does not limit the type of the horizontal stop member 152. In one embodiment shown in FIG. 4A, the horizontal stop member 152 includes a first horizontal bar 152A, a second horizontal bar 152B and a plurality of vertical members 152C, in which the first horizontal bar 152A is spaced from the second horizontal bar 152B by a predetermined spacing, and the vertical members 152C are orderly arranged between the first horizontal bar 152A and the second horizontal bar 152B as the spacers in between.

In addition, except for the constraint-frame coupling member 154 to include the upper interference parts F1, F2, this disclosure does not limit the type of the constraint-frame coupling member 154. In another embodiment shown in FIG. 4A, the constraint-frame coupling member 154 includes a main coupling plate 154A, a first lateral plate 154B, a second lateral plate 154C and a connecting plate 154D. The first lateral plate 154B and the second lateral plate 154C are perpendicular to two sides of the main coupling plate 154A, and extend in the same direction, but are spaced to each other by a distance. Thereupon, the main coupling plate 154A, the first lateral plate 154B and the second lateral plate 154C can be integrated to form a U-shape bending structure to provide a locating groove K1. As shown, one side of the connecting plate 154D is connected with one side of the second lateral plate 154C, or one side of the second lateral plate 154C can be said to be bent for forming the connecting plate 154D. In addition, the first storage layer 130 is connected to the connecting plate 154D.

In this embodiment, the horizontal constraint frame 150 can include a plurality of interference plates F3 connected with the horizontal stop member 152. As shown sin FIG. 4A or FIG. 5A, the horizontal stop member 152 has two interference plates F3 located in a middle section thereof, and a locating groove K2 is formed between these two interference plates F3, while the constraint-frame coupling member 154, connecting the end of the horizontal stop member 152, has another locating groove K1. The constraint-frame coupling member 154 further includes a hanging slot H1 formed at the second lateral plate 154C, and the hanging slot H1 can be used for hanging appropriate fittings for increasing assembly flexibility of the shelf of this disclosure.

In another embodiment shown in FIG. 4B, the horizontal constraint frame 250 includes a horizontal stop member 252 and two constraint-frame coupling members 254. Each of the constraint-frame coupling members 254 is connected with one corresponding end of the horizontal stop member 252. In this embodiment, the horizontal stop member 252 is an extending bent iron plate with a U-shape cross section. Except for the constraint-frame coupling member 254 to have the aforesaid upper interference parts F1, F2, this disclosure does not limit the type of the constraint-frame coupling member 254. In another embodiment shown in FIG. 4B, the constraint-frame coupling member 254 includes a main coupling plate 254A connected with the upper interference parts F1, F2. The first storage layer 130 is furnished with the horizontal constraint frames 250. The horizontal constraint frame 250 can include a plurality of interference plates F4 connected with the horizontal stop member 252. As shown in FIG. 4B, the horizontal stop member 252 has two interference plates F4 at a middle portion thereof, and each of the interference plates F4 is furnished with an interference groove F41 for hanging appropriate fittings to increase the assembly flexibility of the shelf of this disclosure. In addition, a locating groove K2 is formed between these two interference plates F4. Different to FIG. 4A, each end of the horizontal stop member 252 of FIG. 4B is provided with an interference plate F4 to pair the corresponding constraint-frame coupling member 252 for forming a locating groove K3 in between.

Referring back to FIG. 1, in this embodiment, two horizontal constraint frames 150 are individually provided to the front and rear sides of the second storage layer 140. The horizontal constraint frame 150 includes a horizontal stop member 152 and two constraint-frame coupling members 154, and each of the constraint-frame coupling members 154 is connected with the corresponding end of the horizontal stop member 152. In some other embodiments, the horizontal constraint frame 150 can be replaced by the horizontal constraint frame 250 of FIG. 4B.

Figure 6A:
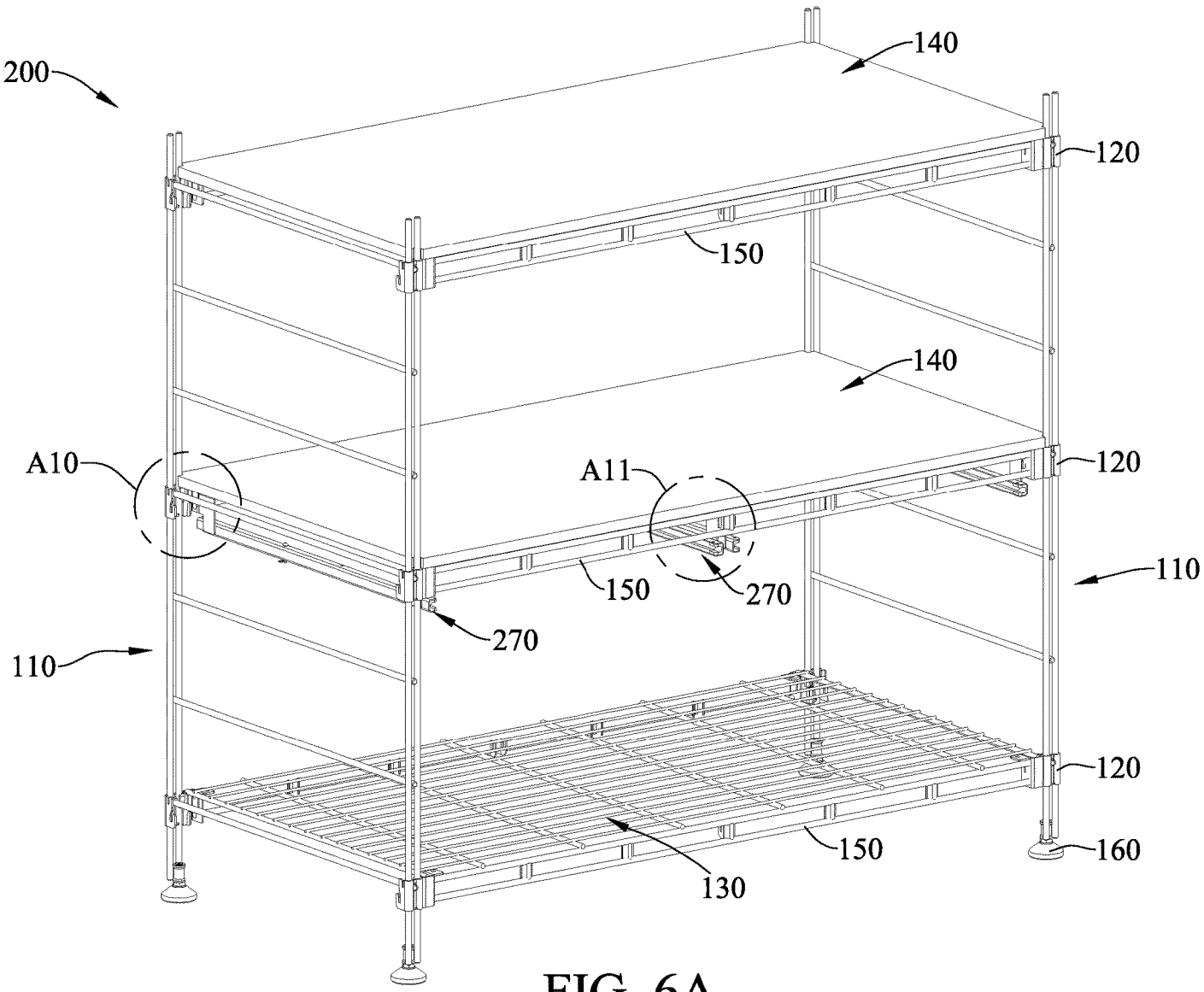
FIG. 6A is a schematic view of another embodiment of the combined type shelf in accordance with this disclosure.
Figure 6C:
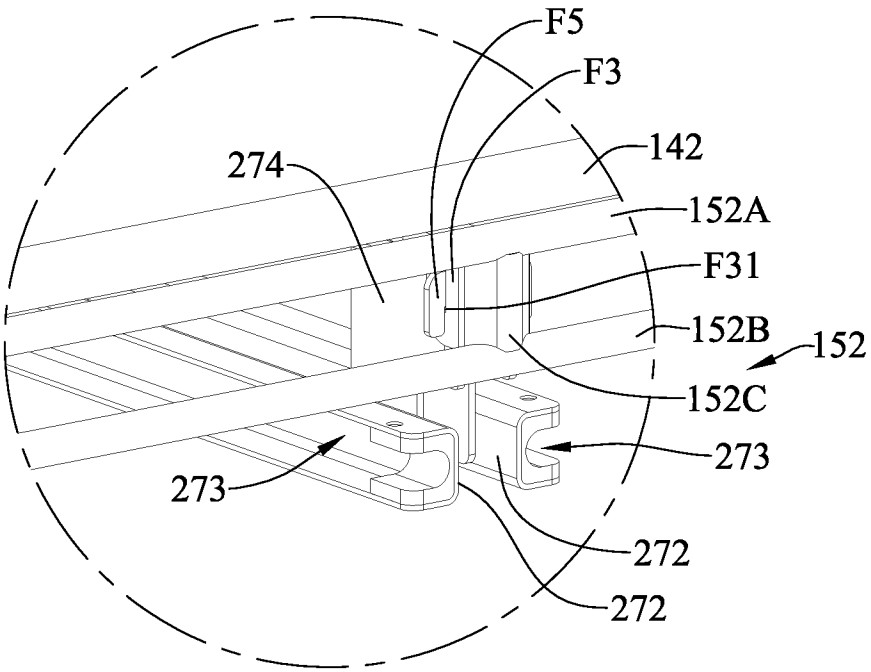
FIG. 6C is an enlarged view of Circle A11 of FIG. 6A.
Figure 6B:
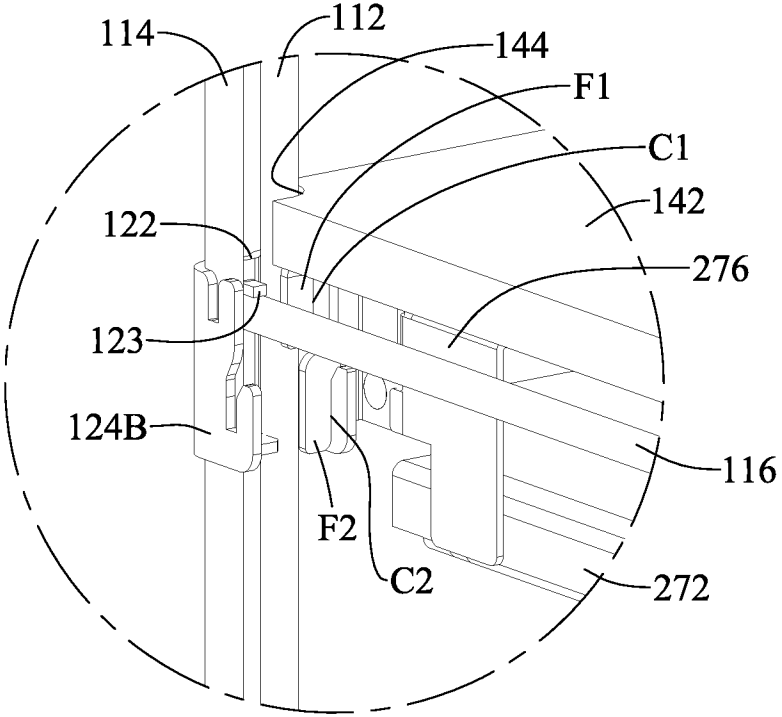
FIG. 6B is an enlarged view of Circle A10 of FIG. 6A.

As shown in FIG. 4A, the hanging slot H1 of the constraint-frame coupling member 154 and the interference plate F3 of the horizontal stop member 152, or the interference plate F4 of the horizontal stop member 252 in FIG. 4B, can be utilized for connecting appropriate fittings. Referring to the embodiment shown from FIG. 6A through FIG. 7, the combined type shelf 200 includes two parallel-rod side frames 110, a plurality of inter-frame connectors 120, a plurality of storage layers consisted of at least a first storage layer 130 and two second storage layers 140, a plurality of horizontal constraint frames 150, at least a standing structure 160 and a plurality of sliding groove structures 270. As shown in FIG. 6A, the sliding groove structures 270, used for adding fittings, are provided to both ends and a middle portion of the horizontal constraint frame 150 mounted to the second storage layer 140 of the combined type shelf 200.

In this embodiment, the second storage layer 140 includes a shelf plate 142 and several corner cutouts 144. Preferably, the corner cutouts 144 are provided right to the corners of the shelf plate 142. As shown in FIG. 6A, while the second storage layer 140 and the connected horizontal constraint frames 150 are lowered down vertically, the corner cutouts 144 of the shelf plate 142 would fit the first vertical bar 142 and the second vertical bar 144. Simultaneously, the upper interference parts F1, F2 would buckle the corresponding lower interference parts C1, C2 so as to have the horizontal constraint frames 150 to engage the corresponding inter-frame connectors 120, and thus the second storage layer 140 can be assembled into the parallel-rod side frame 110.

Figure 7:
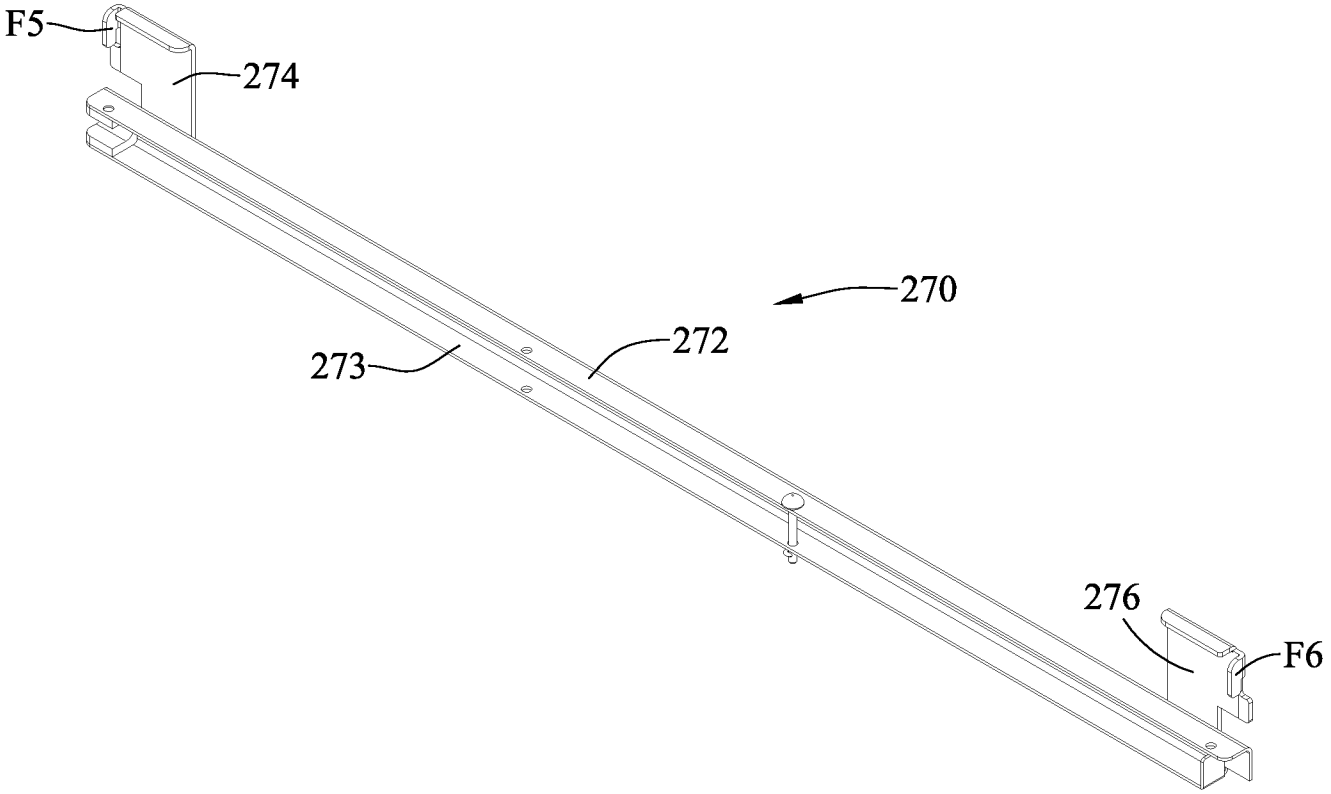
FIG. 7 shows schematically the sliding groove structure of FIG. 6A.

In the embodiment shown in FIG. 7, the sliding groove structure 270 includes a groove body 272, a sliding groove 273, a first mounting plate 274, a second mounting plate 276 and a plurality of upper interference plates F5, F6. The groove body 272 is furnished thereinside with the sliding groove 273, and the first mounting plate 274 and the second mounting plate 276 are disposed to opposite ends of the groove body 272. In addition, the upper interference plates F5, F6 are formed as protrusions of the first mounting plate 274 and the second mounting plate 276, respectively.

The sliding groove structures 270 and the upper interference plates F5, F6 of the horizontal constraint frame 150 of the second storage layer 140 would engage the corresponding hanging slots H1 (as shown in FIG. 4A), such that the two sliding groove structures 270 can be mounted to opposing ends of the horizontal constraint frame 150. On the other hand, the sliding groove structure 270 and the upper interference plates F5 at the middle of the horizontal constraint frame 150 of the second storage layer 140 would be buckled into the interference groove F31 of the corresponding interference plate F3. Similarly, the upper interference plate F6 would be buckled into the interference groove F31 of the corresponding interference plate F3. Thereupon, the sliding groove structure 270 would be mounted at a middle portion of the horizontal constraint frame 150, with two opposite ends of the vertical member 152C at the middle of the horizontal stop member 152 would connect the corresponding interference plates F3. As shown, at the middle portion of the horizontal constraint frame 150, two sliding groove structures 270 can be mounted, with the opening of the sliding groove 273 of each the sliding groove structure 270 to face outward (i.e., to face the corresponding end of the horizontal constraint frame 150). In this embodiment, the opening of the sliding groove 273 of the sliding groove structure 270 can be used for other structures such as a drawer. In some other embodiments, if the horizontal constraint frame 250 of FIG. 4B is utilized, then the upper interference plates F5, F6 of the sliding groove structure 270 would engage the interference grooves F41 of the corresponding interference plates F4, such that the sliding groove structure 270 can be mounted to the middle portion and the opposite ends of the horizontal constraint frame 250.

Figure 8:
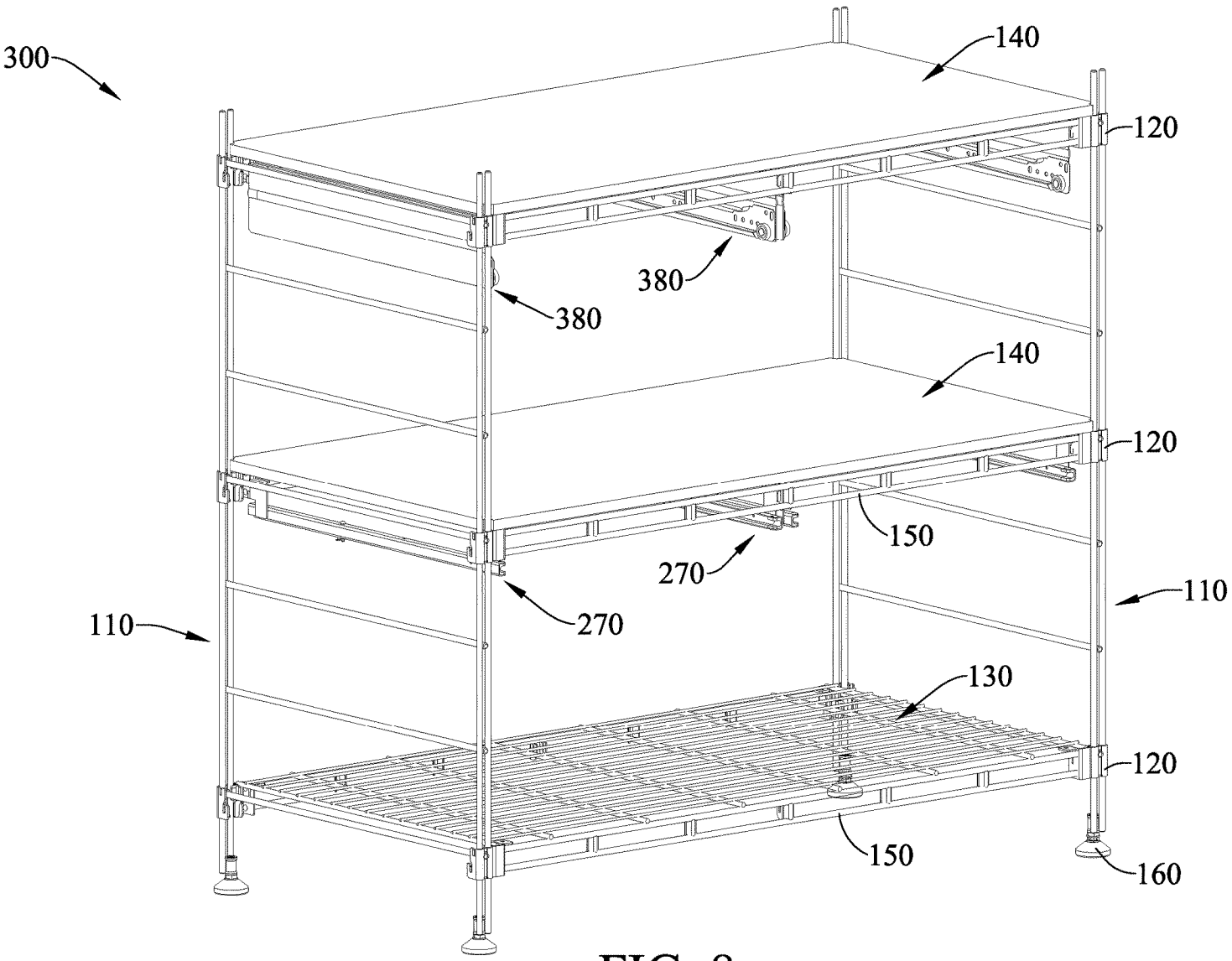
FIG. 8 is a schematic view of a further embodiment of the combined type shelf in accordance with this disclosure.
Figure 9:
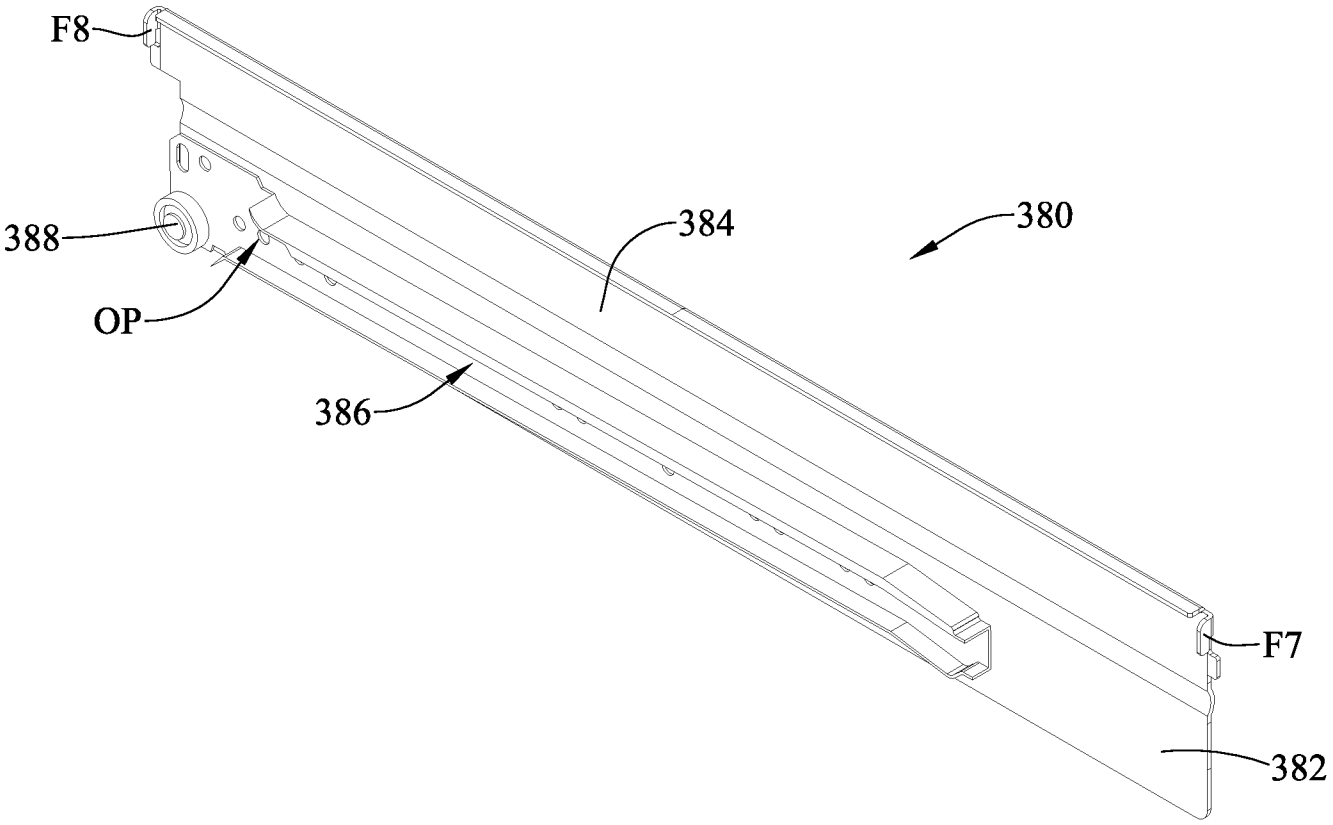
FIG. 9 shows schematically the drawer rack structure of FIG. 8.
Figure 10A:
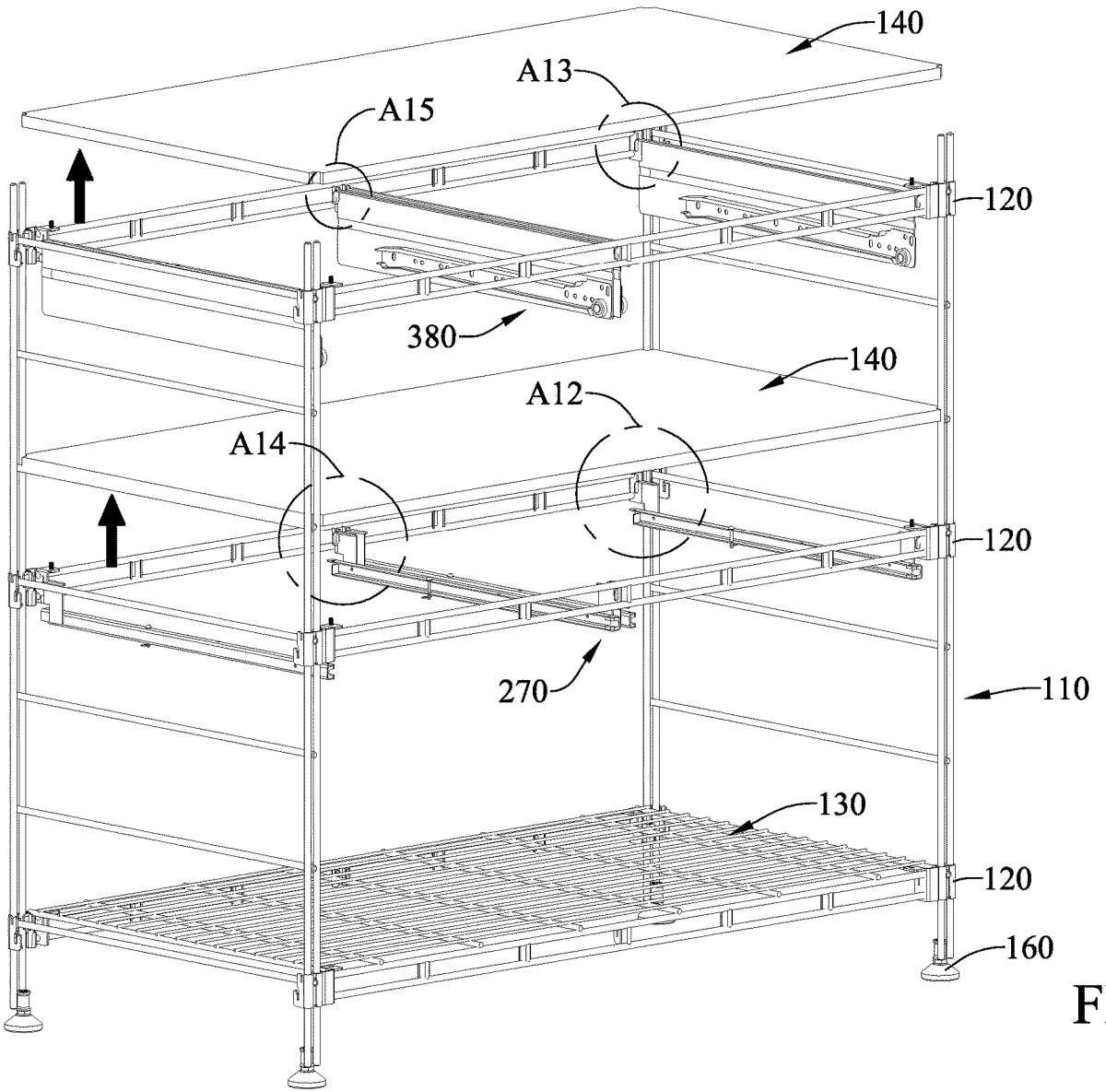
FIG. 10A demonstrates schematically a partly exploded view of FIG. 8.
Figure 10C:
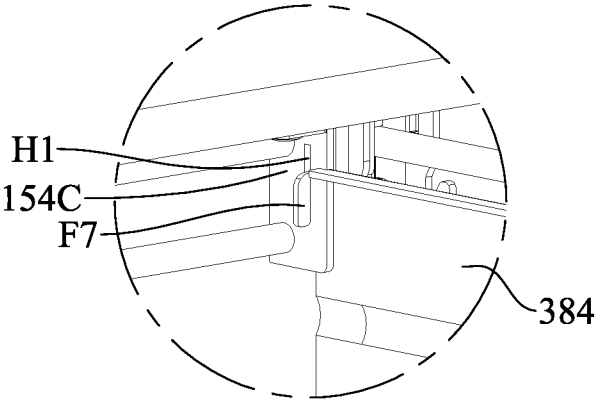
FIG. 10C is an enlarged view of Circle A13 of FIG. 10A.
Figure 10B:
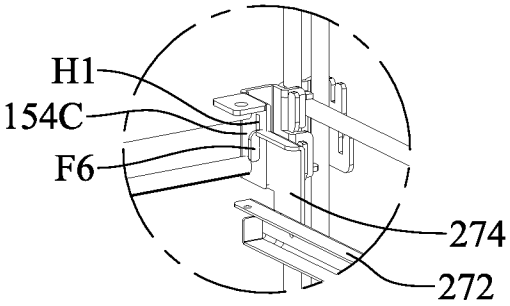
FIG. 10B is an enlarged view of Circle A12 of FIG. 10A.
Figure 10E:
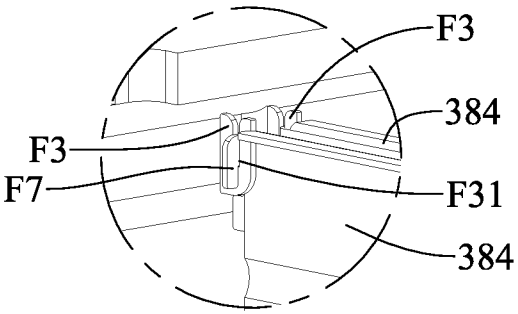
FIG. 10E is an enlarged view of Circle A15 of FIG. 10A.
Figure 10D:
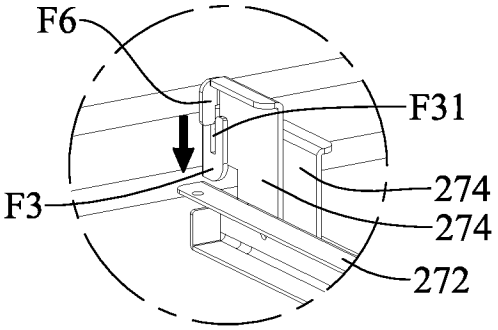
FIG. 10D is an enlarged view of Circle A14 of FIG. 10A.

FIG. 8 is a schematic view of a further embodiment of the combined type shelf in accordance with this disclosure, and FIG. 9 shows schematically the drawer rack structure of FIG. 8. Referring to FIG. 8 and FIG. 9, the combined type shelf 300 includes two parallel-rod side frames 110, a plurality of inter-frame connectors 120, a plurality of storage layers consisted of at least a first storage layer 130 and two second storage layers 140, a plurality of horizontal constraint frames 150, standing structures 160, a plurality of sliding groove structures 270 and a plurality of drawer rack structures 380. As shown in FIG. 8, the sliding groove structures 270 and the drawer rack structures 380 can be treated as fittings of this shelf 300. The sliding groove structure 270 can be referred to the foregoing description upon the embodiment of FIG. 6A through FIG. 7. The drawer rack structures 380 are provided to a middle portion and two opposite ends of the horizontal constraint frame 150 of the second storage layer 140 at an upper portion of the combined type shelf 300.

In this embodiment, the drawer rack structure 380 includes a first plate 382, a second plate 384, a sliding groove 386, an auxiliary roller 388 and a plurality of upper interference plates F7, F8 (as shown in FIG. 9). The first plate 382 is connected with the second plate 384, the sliding groove 386 is provided to the first plate 382, and the auxiliary roller 388 is disposed at the first plate 382 by closing to an entrance OP of the sliding groove 386. Each of the upper interference plates F7, F8 is protruded from a surface of the second plate 384.

Refer to FIG. 10A through FIG. 10E. The upper interference plates F7, F8 engage the corresponding hanging slots H1 (FIG. 10C), such that the drawer rack structures 380 can be installed to the opposite ends of the horizontal constraint frame 150. On the other hand, the drawer rack structure 380 at the middle portion of the horizontal constraint frame 150 of the second storage layer 140, and the upper interference plates F7, F8 are fit to the interference grooves F41 of the corresponding interference plates F4 (FIG. 10E and the interference grooves F41 is shown in FIG. 4B), in which opposite sides of the vertical member 152C (the vertical member 152C is shown in FIG. 4A) at the middle of the horizontal stop member 152 are connected with the corresponding interference plates F3. Thereupon, two drawer rack structures 380 can be installed at the middle of the horizontal constraint frame 150, with the opening of the sliding groove 386 of each the drawer rack structure 380 to face the corresponding end of the horizontal constraint frame 150, such that the structure such as the drawer can be assembled thereto. In some other embodiments, if the horizontal constraint frame 250 of FIG. 4B is applied, then the upper interference plates F7, F8 of the drawer rack structure 380 would engage the corresponding interference grooves F41 of the respective interference plates F4. As such, the drawer rack structures 380 can be installed to the middle and opposite ends of the horizontal constraint frame 250.

Though, in any of the aforesaid embodiments, the combined type shelf includes only a single row of storage layers, yet this disclosure is not limited thereto. Referring to FIG. 1, FIG. 2B or FIG. 5B, the inter-frame connector 120 of this disclosure has two lateral plates 124A, 124B furnished with respective lower interference parts C1, C2. When the inter-frame connector 120 and the horizontal constraint frame 150 are assembled, only one of the lower interference parts C1, C2 of the lateral plate 124A or the lateral plate 124B of the inter-frame connector 120 is actually required to buckle the upper interference parts F1, F2 of the horizontal constraint frame 150. Namely, if the lower interference parts C1, C2 of the lateral plate 124A of FIG. 5B have been buckled with the upper interference parts F1, F2 of the horizontal constraint frame 150, then the lower interference parts C1, C2 of the lateral plate 124B of FIG. 5B can be used to engage the upper interference parts F1, F2 of another horizontal constraint frame 150, such that the inter-frame connector 120 can be utilized in a purpose of connection balance. Hence, an additional parallel-rod side frame 110 and additional horizontal constraint frames 150 can be added into either the right side or the left side of the combined type shelf of FIG. 1. Such an addition would be elucidated as follows according to FIG. 11A through FIG. 16.

Figure 11A:
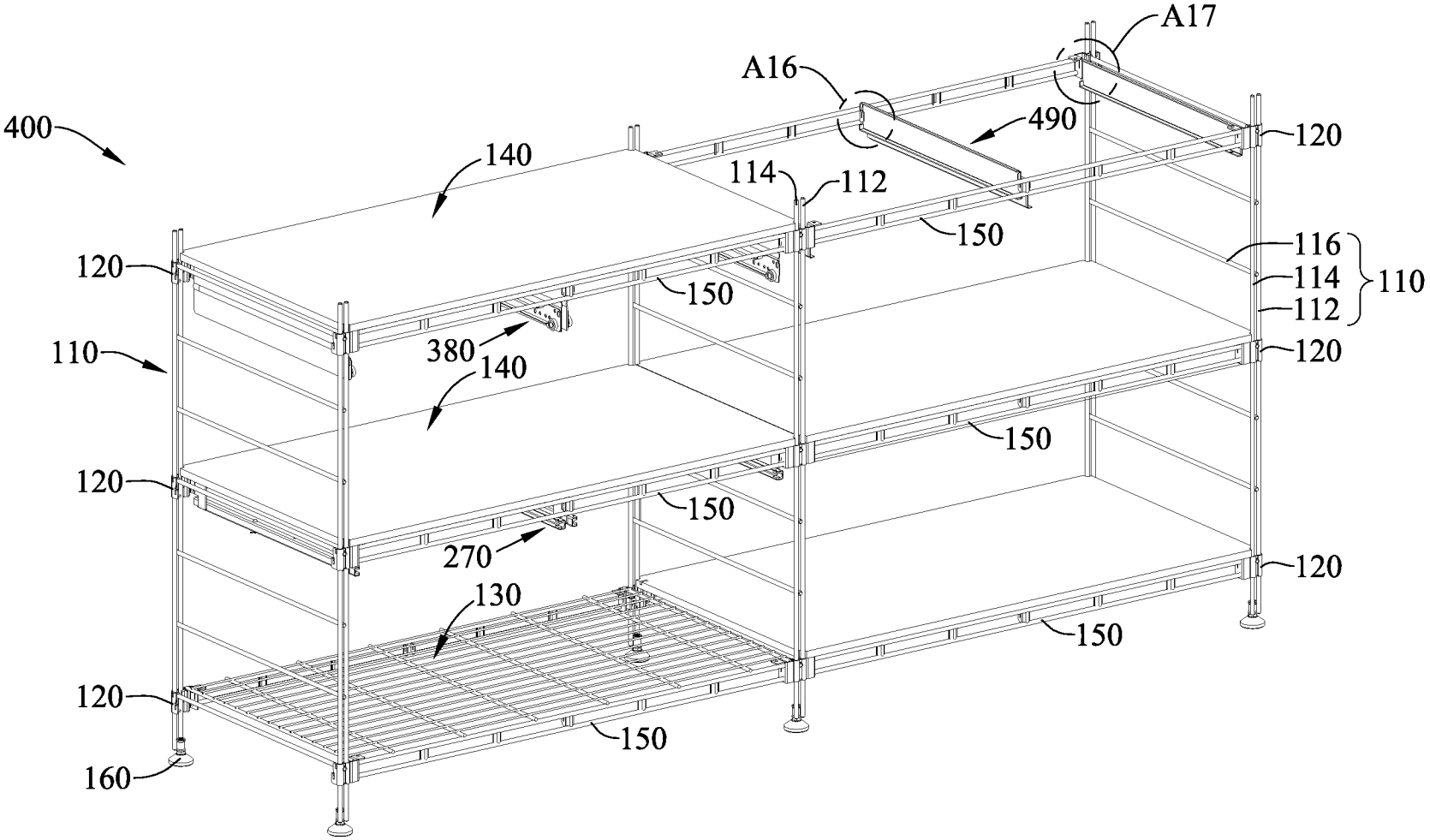
FIG. 11A is a schematic view of one more embodiment of the combined type shelf in accordance with this disclosure.
Figure 11C:
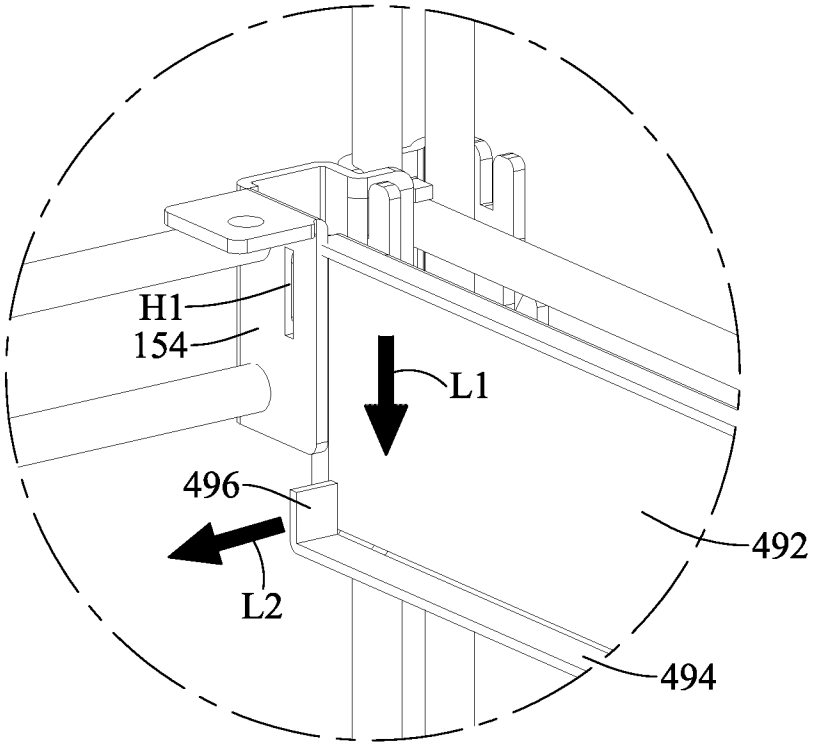
FIG. 11C is an enlarged view of Circle A17 of FIG. 11A.
Figure 11B:
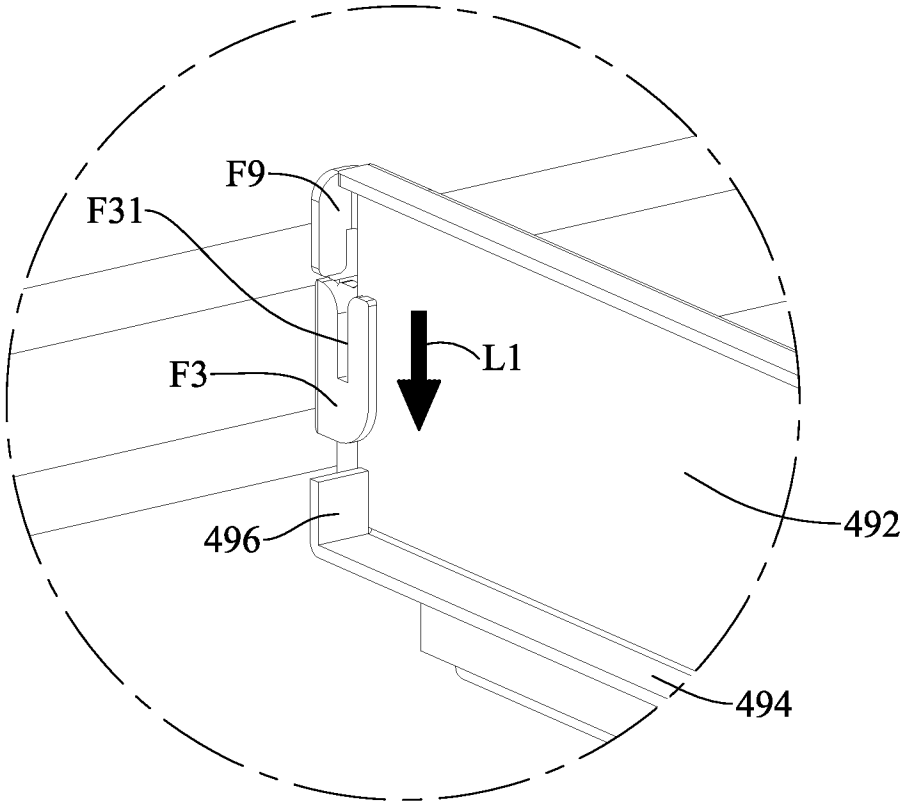
FIG. 11B is an enlarged view of Circle A16 of FIG. 11A.

Referring to FIG. 11A through FIG. 11C, in this embodiment, the combined type shelf 400 includes three parallel-rod side frames 110, a plurality of inter-frame connectors 120, a plurality of storage layers consisted of a first storage layer 130 and plural second storage layers 140, a plurality of horizontal constraint frames 150, standing structures 160, a plurality of sliding groove structures 270, a plurality of drawer rack structures 380 and at least one sliding rack structure 490.

In this embodiment, the combined type shelf 400 has three parallel-rod side frames 110, and each of the parallel-rod side frames 110 is furnished with the inter-frame connectors 120. The horizontal constraint frames 150 and the inter-frame connectors 120 are applied to assemble the two neighboring parallel-rod side frames. In particular, the middle parallel-rod side frame 110 and the associated inter-frame connectors 120 would finish the connection with the parallel-rod side frame 110 at one side first, and then proceed to connect the parallel-rod side frame 110 at the other side, such that the combined type shelf 400 can be formed, in which the first storage layer 130 and the second storage layer 140 are located between the two parallel-rod side frames 110.

In this embodiment, the sliding groove structure 270, the drawer rack structure 380 and the sliding rack structure 490 can be seen as fittings of the shelf 400. The sliding groove structure 270 can be referred to foregoing descriptions related to FIG. 6A through FIG. 7, and the drawer rack structure 380 can be referred to foregoing descriptions related to FIG. 8 and FIG. 9. In this embodiment, the combined type shelf 400 has two upper layers. One of the two upper layers includes the second storage layer 140 and the drawer rack structure 380 mounted to the horizontal constraint frames 150, while another thereof includes the sliding rack structures 490 mounted at the middle and two opposite ends of the horizontal constraint frame 150.

In one embodiment, the sliding rack structure 490 includes a main rack plate 492, a rack 494 and a plurality of upper interference plates F9. The rack 494, disposed at the main rack plate 492, can be formed as a protrusive plate from the main rack plate 492, and can be used as a sliding rack to pair the drawer having a relevant sliding groove. In addition, a rack-end plate 496 can be provided to the rack 494 as a stop structure for the sliding drawer. On the other hand, the upper interference plate F9 is protruded from the surface of the main rack plate 492, and the rack 494 is a bent-up plate structure at the lower edge of the main rack plate 492, while the upper interference plates F9 are protrusions from the front and rear ends of the main rack plate 492 for buckling the front and rear horizontal constraint frames 150.

In FIG. 11B, the sliding rack structure 490 is disposed at a middle position of the horizontal constraint frame 150. While in assembling, the sliding rack structure 490 is moved downward in the first direction L1 to have the upper interference plate F9 to buckle the interference groove F31 at the corresponding interference plate F3, such that the sliding rack structure 490 can couple the horizontal constraint frame 150. In addition, as shown in FIG. 11C, the sliding rack structure 490 is disposed at either of the two opposite ends of the horizontal constraint frame 150. While in assembling, the sliding rack structure 490 is moved downward in the first direction L1 to have the upper interference plate F9 to reach a position respective to the hanging slot H1. Then, the sliding rack structure 490 is moved in the second direction L2 to have the upper interference plate F9 to move toward the hanging slot H1 till the upper interference plate F9 buckles the hanging slot H1. Thereupon, the sliding rack structure 490 can connect the horizontal constraint frame 150. Similarly, as shown in FIG. 4A, if two opposite ends of the vertical member 152C at the middle of the horizontal stop member 152 connect the corresponding interference plates F3, then two sliding rack structures 490 can be mounted at the middle of the horizontal constraint frame 150. With the two racks 494 of the two sliding rack structures 490 to be properly aligned, the drawer or the like structure can be mounted in between. In some other embodiments, if the horizontal constraint frame 250 of FIG. 4B is applied, then the upper interference plate F9 of the sliding rack structure 490 would buckle the interference groove F41 of the corresponding interference plate F4. Thereupon, the sliding rack structures 490 can be mounted to the middle and two opposite ends of the horizontal constraint frame 250.

Figure 12A:
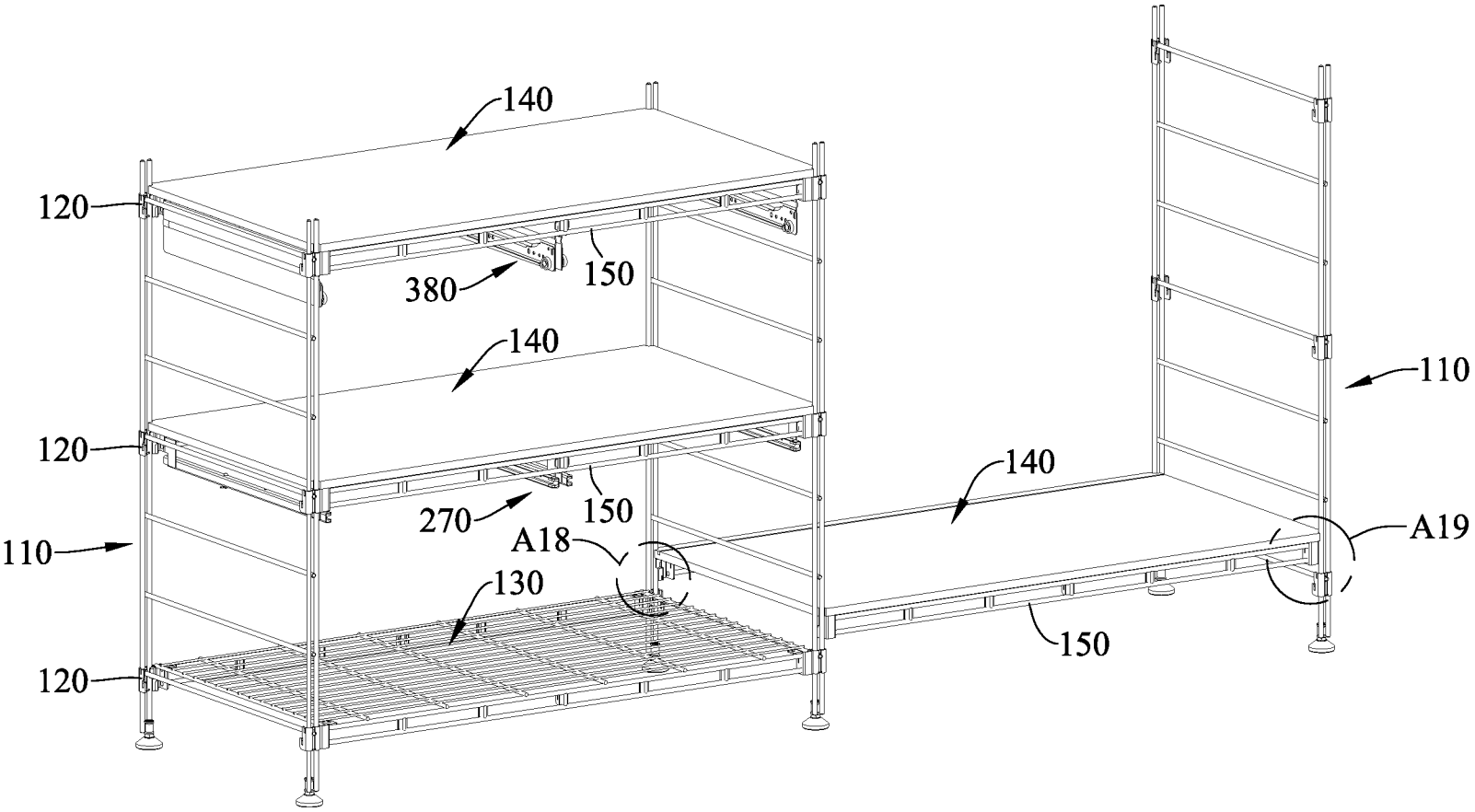
FIG. 12A shows schematically the second storage layer and the horizontal constraint frame to be mounted to the combined type shelf of FIG. 11A.
Figure 12C:
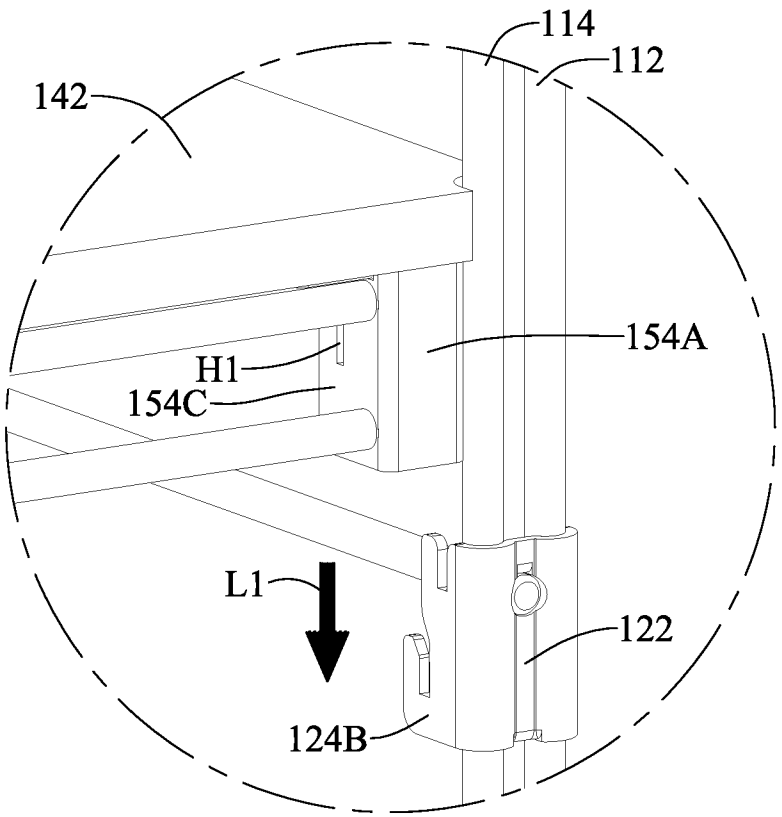
FIG. 12C is an enlarged view of Circle A18 of FIG. 12A.
Figure 12B:
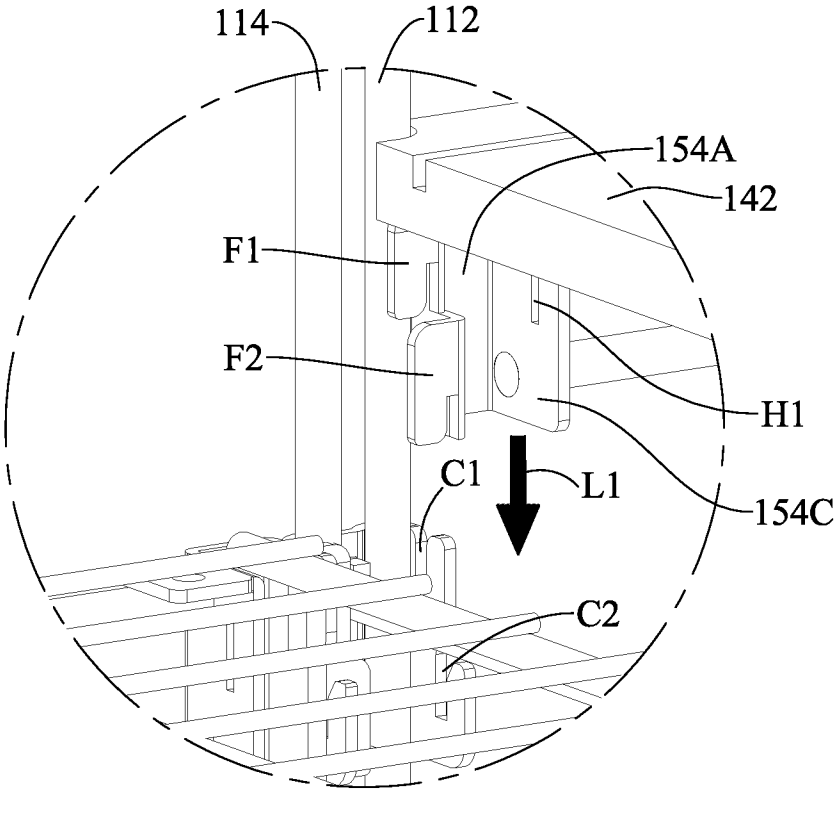
FIG. 12B is an enlarged view of Circle A18 of FIG. 12A.

In this embodiment, as shown in FIG. 11A, assembling of the combined type shelf 400 can be referred to FIG. 12A through FIG. 16. Firstly, refer to FIG. 12A through FIG. 12C. As shown in FIG. 12A, a complete-assembled shelf is located at a left side of the drawing, while the other side thereof is a shelf structure yet to complete. At the left side of FIG. 12A, one first storage layer 130, two second storage layers 140, plural horizontal constraint frames 150, plural sliding groove structures 270 and plural drawer rack structures 380 are mounted between the two parallel-rod side frames 110, and detailed structuring thereabout can be referred to the aforesaid embodiments shown from FIG. 1 to FIG. 10E. In comparison with any embodiment from FIG. 1 to FIG. 10E, this embodiment is further added by a parallel-rod side frame 110, and a second storage layer 140 and associated horizontal constraint frames 150 are further assembled to the middle parallel-rod side frame 110. As shown in FIG. 12A and FIG. 12B, the lower interference parts C1, C2 at one side of each the inter-frame connector 120 are connected with the first storage layer 130, while the lower interference parts C1, C2 at another side thereof are connected with the upper interference parts F1, F2 of the corresponding horizontal constraint frame 150 provided to the second storage layer 140, such that the lowest storage layers at the left-hand side and the right-hand side of the combined type shelf would be different structured. Similarly, as shown in FIG. 12A and FIG. 12C, the connection between the inter-frame connector 120 at the rightest parallel-rod side frame 110 and the horizontal constraint frame 150 is similar to the aforesaid description, and thus detail thereabout would be omitted herein.

Figure 13:
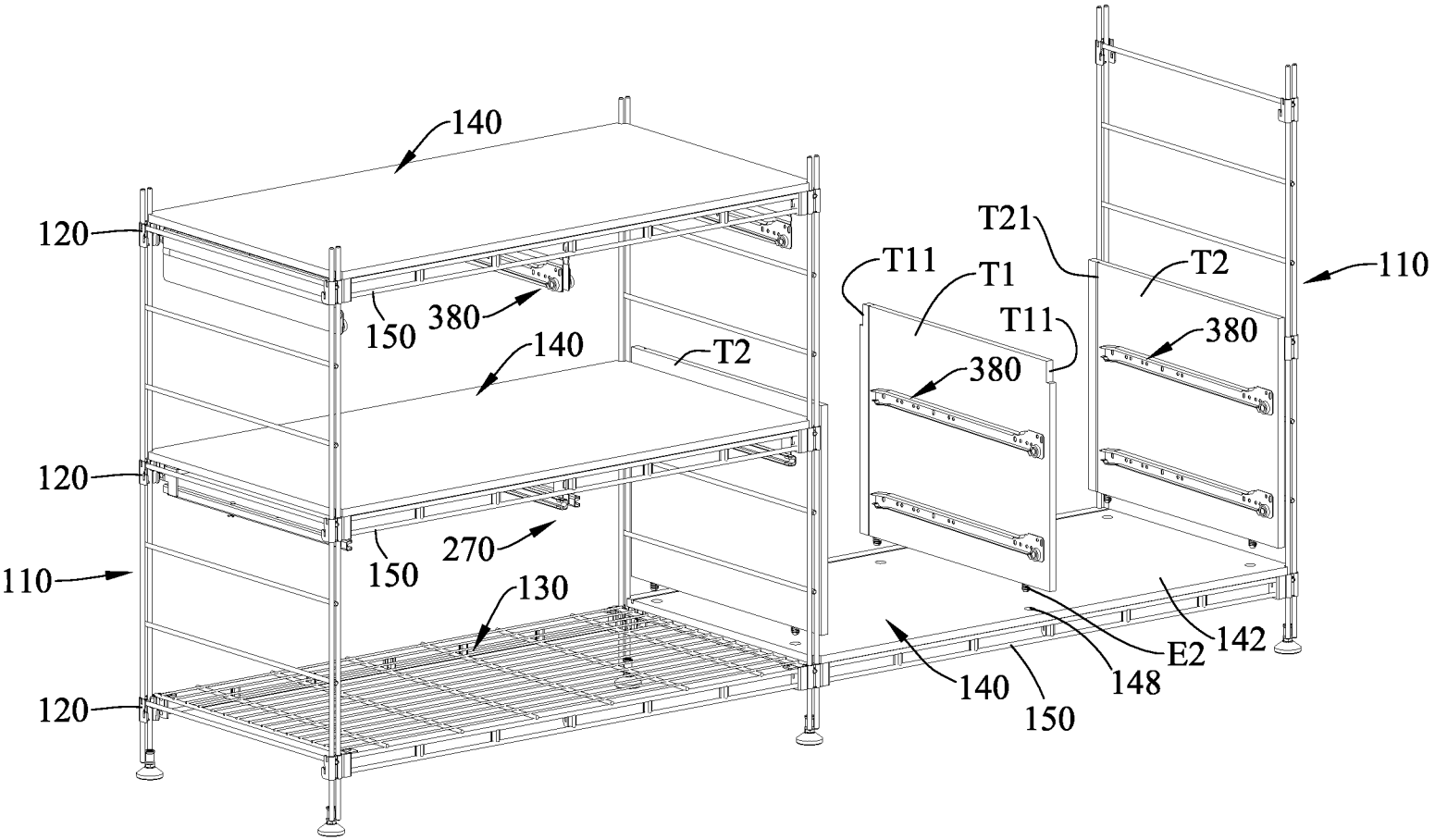
FIG. 13 shows schematically the first vertical side plate and the second vertical side plate to be mounted to the combined type shelf of FIG. 12A.
Figure 14:
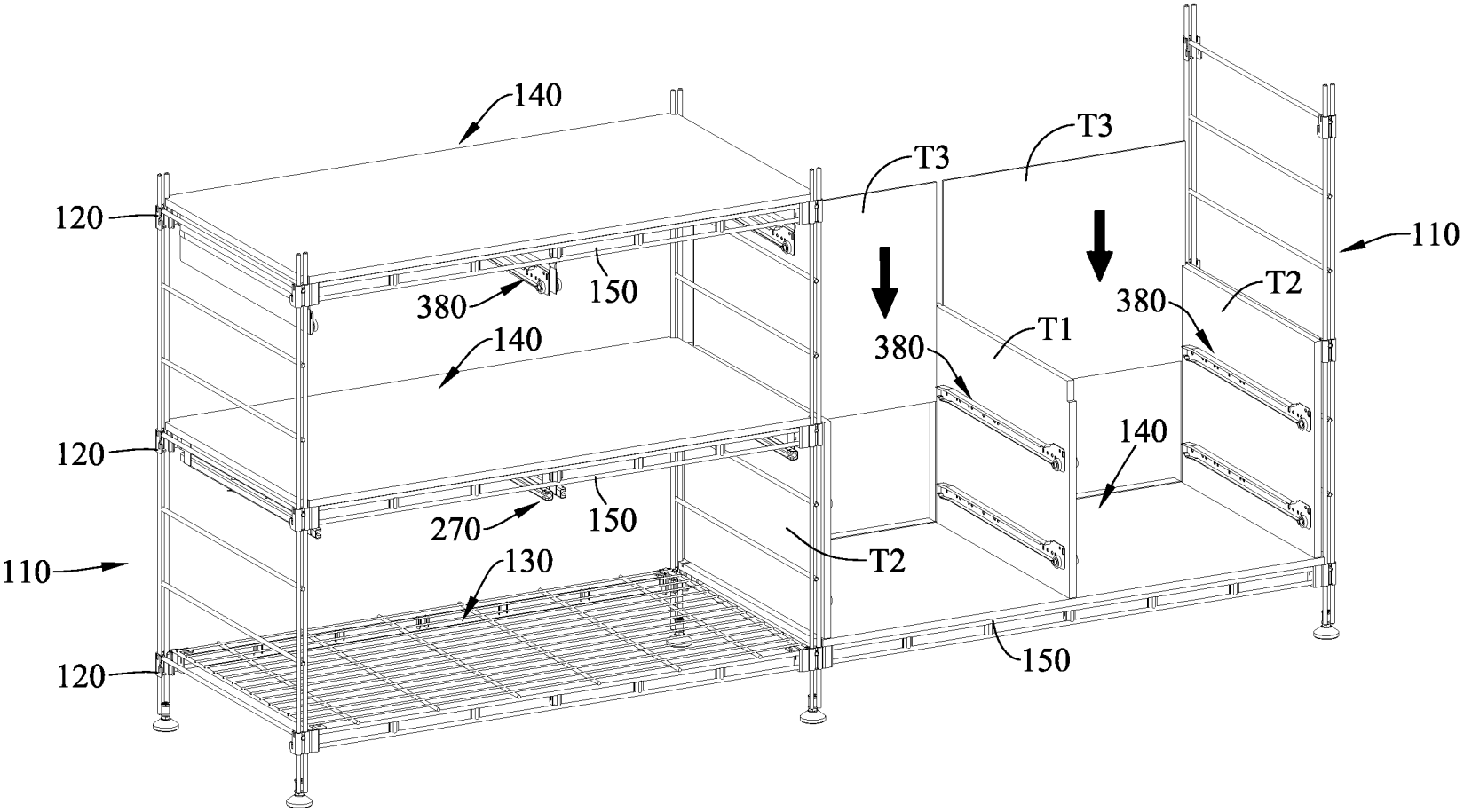
FIG. 14 shows schematically the vertical back plate to be mounted to the combined type shelf of FIG. 13.

Referring to FIG. 13 and FIG. 14, the combined type shelf 400 further includes a plurality of different vertical side plates including at least a first vertical side plate T1, a second vertical side plate T2 and a vertical back plate T3 disposed at different places. By having FIG. 13 as an example, the first vertical side plate T1 and the two second vertical side plates T2 are vertically mounted on the shelf plate 142 of the second storage layer 140, in which the first vertical side plate T1 is spaced from each of the two second vertical side plates T2 by a predetermined distance. With the first vertical side plate T1 and the two second vertical side plates T2, the drawer rack structures 380 can be established thereon. In some other embodiments, the first vertical side plate T1 and the two second vertical side plates T2 might need no drawer rack structure 380 to be constructed thereon.

Practically, as shown in FIG. 13, lock pins E2 extending downward can be provided to bottoms of the first vertical side plate T1 and the two second vertical side plates T2. The lock pin E2 is designed to plug a corresponding locking hole 148 on the shelf plate 142, such that the first vertical side plate T1 and the second vertical side plates T2 can be assembled onto the shelf plate 142. The first vertical side plate T1 is further furnished with corner cutouts T1 at upper ends of the opposite lateral sides thereof, and rear sides of the first vertical side plate T1 and the two second vertical side plates T2 are further furnished with individual vertical assembly grooves T21. Then, as shown in FIG. 14, two vertical back plates T3 can be mounted to the rear sides of the vertical side plates T1, T2 by having opposite lateral sides thereof to slide down along these assembly grooves T21. Then, the combined type shelf 400 can have two lower parallel storage spaces at the right-hand side of the shelf 400.

Figure 15:
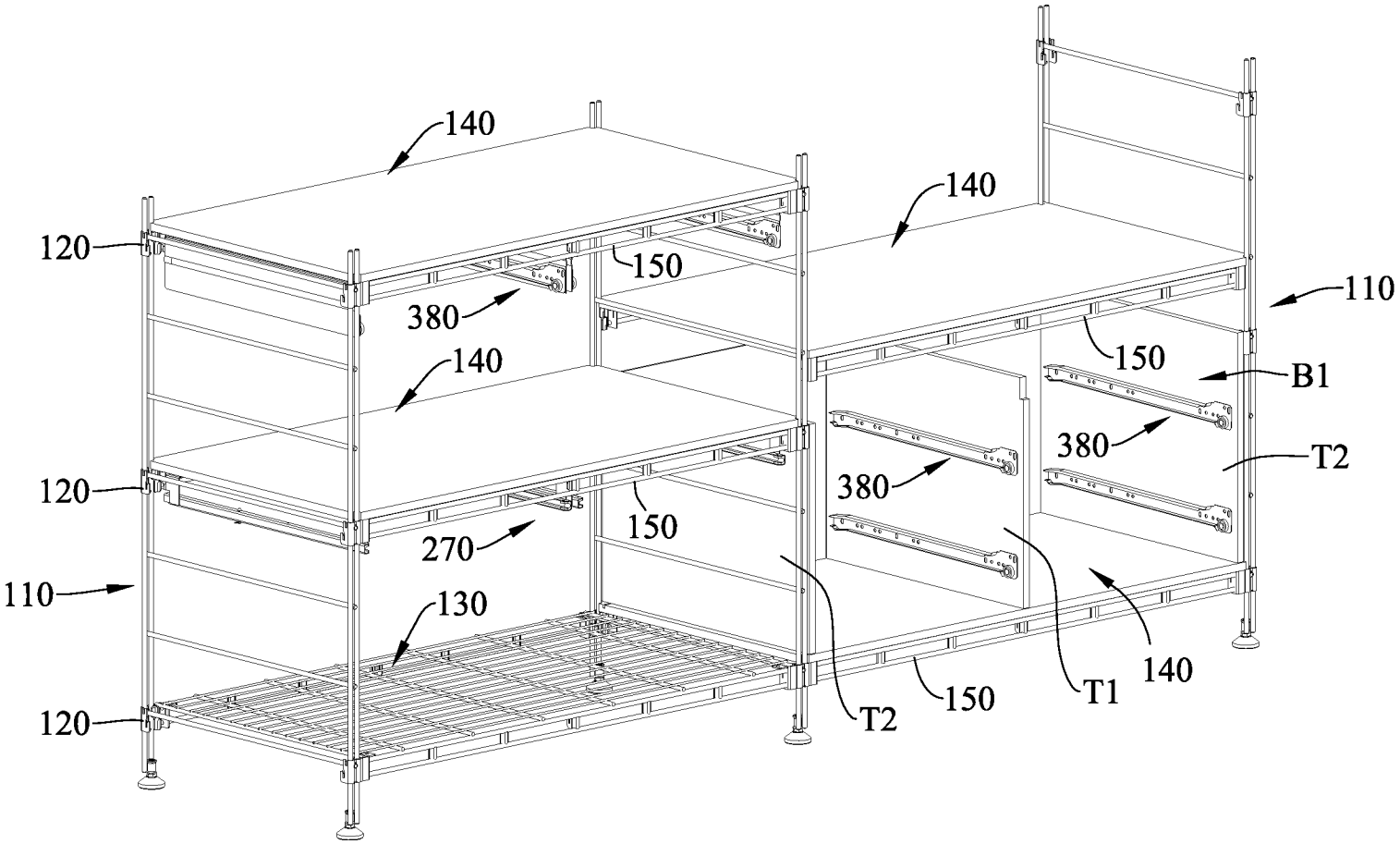
FIG. 15 shows schematically the second storage layer and the horizontal constraint frame to be mounted to the combined type shelf of FIG. 14.
Figure 16:
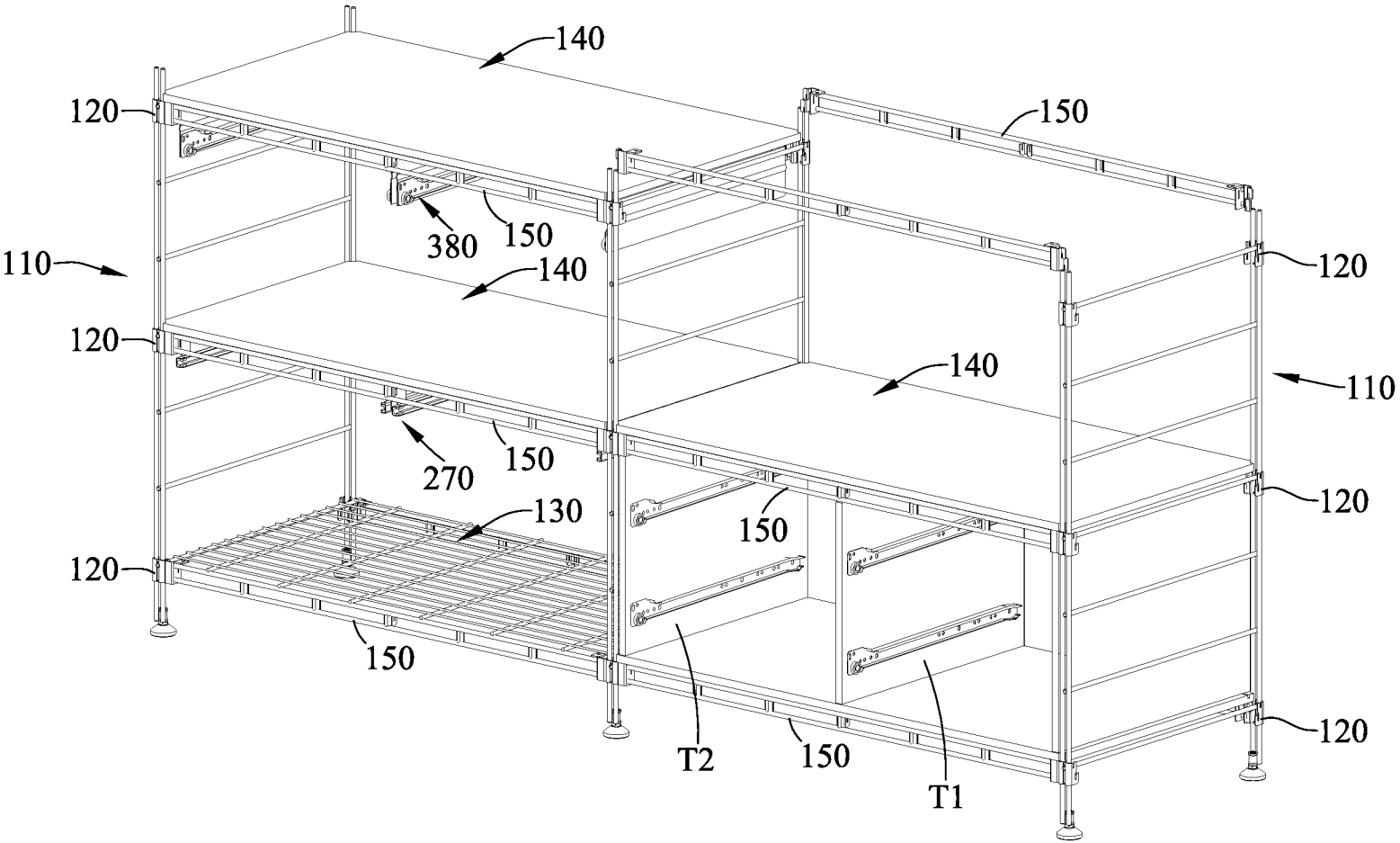
FIG. 16 shows schematically the horizontal constraint frame to be mounted to the combined type shelf of FIG. 15.

Then, as shown in FIG. 15 and FIG. 16, two second storage layers 140 and the associated horizontal constraint frames 150 are assembled to a middle layer at the right-hand side of the combined type shelf 400, and to a top layer at the other side thereof. Since the assembling method here is the same as the aforesaid method, thus detail thereabout would be omitted herein. In particular, while the horizontal constraint frame 150 is moved downward, the locating grooves K1, K2 here, resembled to those described in FIG. 4A or FIG. 5A, would clamp the first vertical side plate T1 and the second vertical side plates T2, such that the first vertical side plate T1 and the second vertical side plates T2 can be positioned. Thereupon, the first vertical side plate T1, the second vertical side plates T2 and the vertical back plates T3 can be assembled to form a drawer space B1. That is, through the locating grooves K1, K2 of this embodiment, no specific locking, assembling and positioning means is required to form a drawer space, a cupboard or a storage box. Thus, the object of this disclosure in saving time and labors can be achieved. Of course, with the locating grooves K2, K3 of the horizontal constraint frame 250 in FIG. 4B to clamp the first vertical side plate T1 and the second vertical side plates T2, the first vertical side plate T1 and the second vertical side plates T2 can be also positioned. In some other embodiments, according to practical requirements, the first vertical side plate T1, the second vertical side plate T2, the vertical back plate T3 and the like plate structure can be properly assembled to form a cupboard B2 or a storage box B3 (see FIG. 17).

Figure 17:
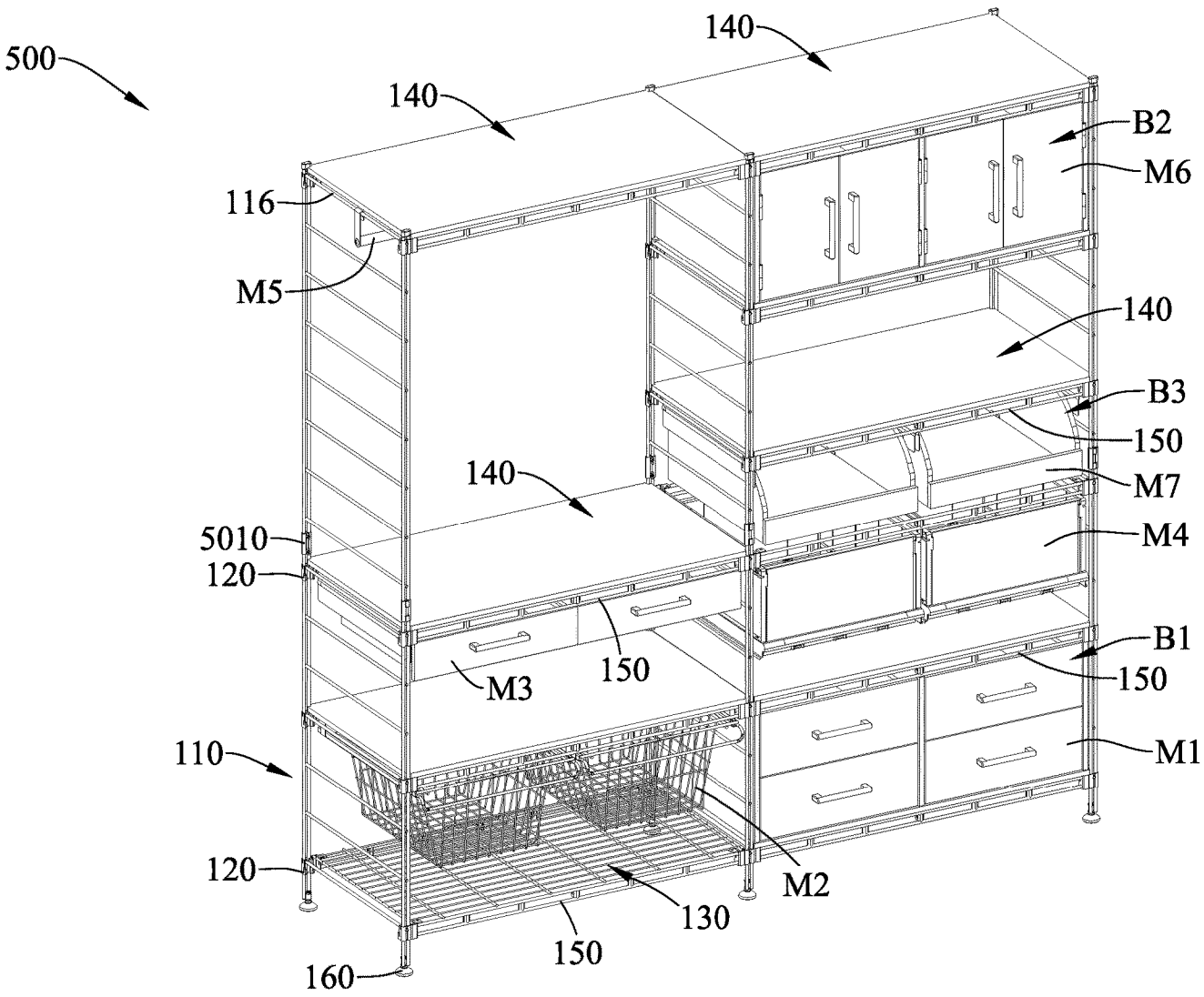
FIG. 17 is a schematic view of one further more embodiment of the combined type shelf in accordance with this disclosure.

As described above, the horizontal constraint frame 150 can be further provided with specific structures such as the sliding groove structure 270, the drawer rack structure 380 and the sliding rack structure 490. However, this disclosure is not limited to the aforesaid applications, and actually, according to this disclosure, the amounts and positions of the sliding groove structure 270, the drawer rack structure 380 and the sliding rack structure 490 can be varied to meet practical needs. In addition, the horizontal constraint frame 250 in FIG. 4B can also be an option. In the following description, FIG. 17 is raised as an example to explain structures for pairing the sliding groove structure 270, the drawer rack structure 380 and the sliding rack structure 490.

Figure 18A:
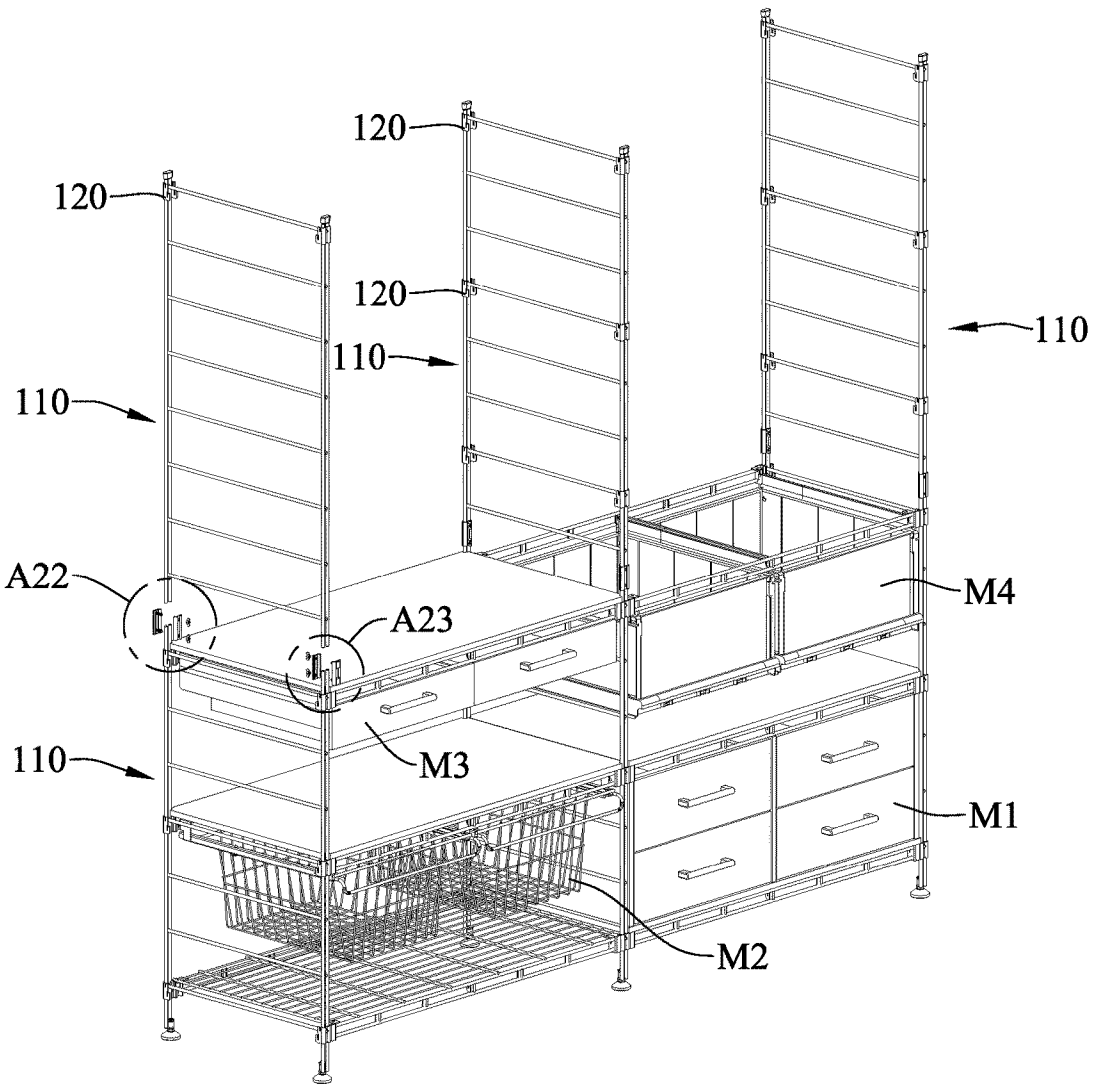
FIG. 18A shows schematically the parallel-rod side frame to be mounted in the combined type shelf of FIG. 17.
Figure 18C:
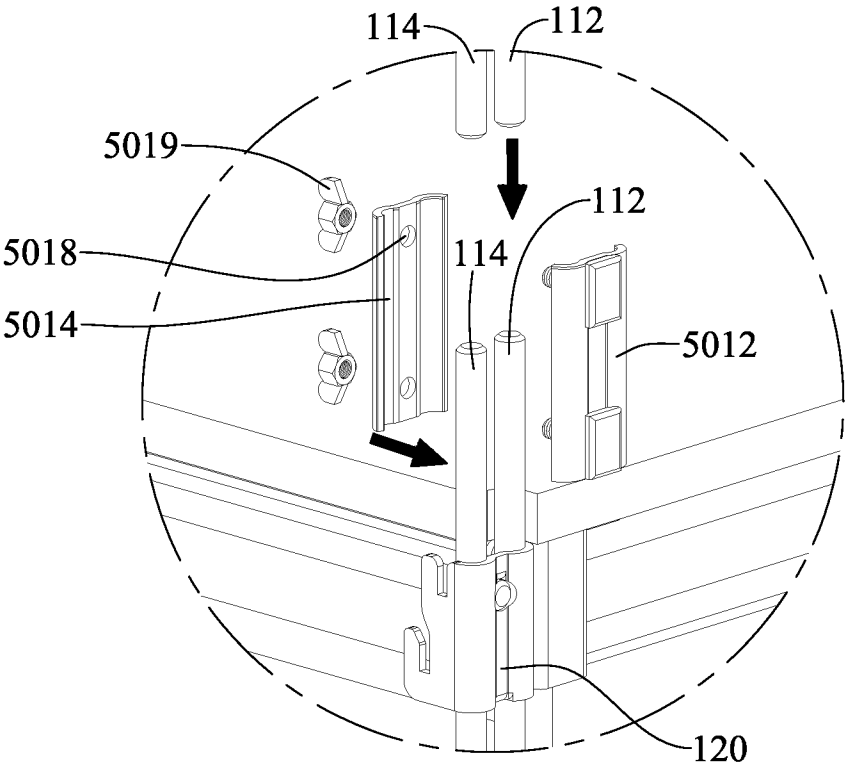
FIG. 18C is an enlarged view of Circle A18 of FIG. 12A.
Figure 18B:
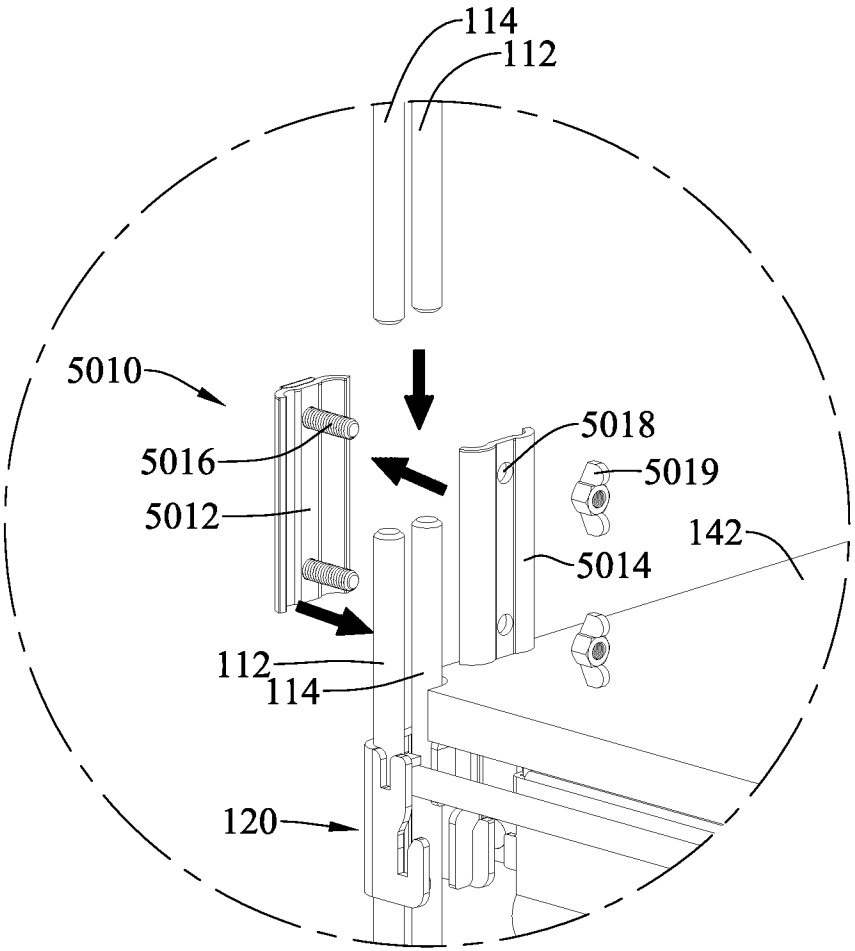
FIG. 18B is an enlarged view of Circle A22 of FIG. 17A.

From FIG. 1 through FIG. 16, though any of the combined type shelves 100, 200, 300, 400 has only two layers, yet this disclosure is not limited thereto. Except for the addition of horizontal storage shelves, additional vertical storage frames can also be implemented. As follows, FIG. 17 through FIG. 18C would be raised as examples for explanation.

In this embodiment, the combined type shelf 500 includes a plurality of parallel-rod side frames 110 (six fir example), a plurality of inter-frame connectors 120, a plurality of storage layers having at least a first storage layer 130 and several second storage layers 140, a plurality of horizontal constraint frames 150, plural standing structures 160, plural sliding groove structures 270, drawer rack structures 380, sliding rack structures 490 and assembly components 5010, so as to form the combined type shelf 500 having at least upper, middle and lower layers. The arrangement of the sliding groove structure 270, the drawer rack structure 380 and the sliding rack structure 490 can be referred to the aforesaid embodiments. The combined type shelf 500 can be structured to have at least a drawer M1, a storage basket M2, another drawer M3, a storage box M4, a hanger bar M5, a swing door M6 and a box M7, in which the hanger bar M5 can hang at the horizontal bar 116.

In this embodiment, the drawer M1, disposed at the lower right layer of the combined type shelf 500, is movable via the drawer rack structures 380; the storage basket M2, disposed at the lower left layer of the combined type shelf 500, is movable via the sliding groove structures 270; the drawer M3, disposed at the upper left layer of the combined type shelf 500, is also movable via the drawer rack structures 380; and, the storage box M4, disposed at the upper right layer of the combined type shelf 500, is movable via the sliding rack structures 490. It shall be explained that, by evaluating practical situations, positions of the aforesaid drawer M1, storage basket M2, drawer M3 and storage box M4 in the combined type shelf 500 can be adjusted through properly arranging the interference plate F3 of the horizontal constraint frame 150 (or the interference plate F4 of the horizontal constraint frame 250 in FIG. 4B), the upper interference plates F5, F6 of the sliding groove structure 270, the upper interference plates F7, F8 of the drawer rack structure 380, and the upper interference plate F9 of the sliding rack structure 490.

Practically, the assembly component 5010 includes a first half shell 5012, a second half shell 5014, a plurality of first fasteners 5016, a plurality of fastener holes 5018 and a plurality of second fasteners 5019. The first half shell 5012 and the second half shell 5014 are together to wrap the first vertical bar 112 and the second vertical bar 114. By having the first fasteners 5016 to penetrate through the corresponding fastener holes 5018, and by applying the second fasteners 5019 to form locking between the first fasteners 5016 and the corresponding second fasteners 5019, the first half shell 5012 and the second half shell 5014 can be assembled together. Of course, in order to cut down the usage of the assembly components 5010, the first vertical bar 112 and the second vertical bar 114 can be made longer. However, such a move would make difficult the transportation and the storage. Thus, it would be preferable to make the first vertical bars 112 and the second vertical bars 114 with different but constant lengths, and then the assembly convenience can be promoted.

In summary, in the combined type shelf provided by this disclosure, no assembly tool is required, and the new design at the horizontal constraint frame is introduced to pair the buckling by the lower interference parts of the inter-frame connector at the parallel-rod side frame, such that the object of assembly convenience can be achieved. Also, the horizontal constraint frame can be used to stabilize the entire structure of the combined type shelf, and thus no more crossing traction wires in the art is required.

Further, the horizontal constraint frame is provided with hanging capacity, and thereby additional functions or fittings can be added per practical requirements, such that assembling flexibility of the entire combined type shelf can be further enhanced.

In addition, this disclosure utilizes the locating grooves on the horizontal stop member, and thus no other locking means is necessary for assembling or positioning the drawer, cupboard or storage box. Thereupon, the object of saving time and labor can be obtained.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A combined type shelf, comprising:

at least two parallel-rod side frames, each of the parallel-rod side frames including two vertical bar assemblies and a plurality of horizontal bars, each of the plurality of horizontal bars being disposed within corresponding one of the two vertical bar assemblies, wherein each of the two vertical bar assemblies includes a first vertical bar and a second vertical bar parallel to the first vertical bar in a side-by-side manner, each of the plurality of horizontal bars has two opposite ends, and each of the two opposite ends is fixed between the first vertical bar and the second vertical bar of the corresponding one of the two vertical bar assemblies;

a plurality of inter-frame connectors, each of the plurality of inter-frame connectors including a connector body, two lateral plates, a hole and at least one lower interference part, wherein the connector body has two opposite sides extending outward to form the two lateral plates, the hole is disposed at the connector body, each of the at least one lower interference part is disposed at corresponding one of the two lateral plates, and each of the plurality of horizontal bars penetrates the corresponding hole, such that the connector body and each of the two lateral plates surround the first vertical bar and the second vertical bar;

a plurality of storage layers, disposed between two of the at least two parallel-rod side frames; and a plurality of horizontal constraint frames, each of the plurality of storage layers being furnished with at least one of the plurality of horizontal constraint frames, each of the plurality of horizontal constraint frames including a horizontal stop member and two constraint-frame coupling members, each of the two constraint-frame coupling members being connected with one corresponding end of the horizontal stop member, each of the two constraint-frame coupling members including at least one upper interference part, each of the at least one upper interference part being buckled with the at least one lower interference part, such that each of the plurality of horizontal constraint frames is connected with corresponding one of the plurality of inter-frame connectors.

2. The combined type shelf of claim 1, further including a plurality of interference plates, each of the plurality of interference plates being connected with the corresponding horizontal stop member.

3. The combined type shelf of claim 2, further including a plurality of upper interference plates, each of the plurality of upper interference plates being buckled with corresponding one of the plurality of interference plates.

4. The combined type shelf of claim 2, further including a plurality of locating grooves disposed among the plurality of interference plates, between each of the plurality of interference plates and the corresponding constraint-frame coupling member, or within the constraint-frame coupling member, wherein each of the plurality of locating grooves is used for clamping corresponding one of the at least one vertical side plate to further position each of the at least one vertical side plate on one of the plurality of storage layers.

5. The combined type shelf of claim 4, wherein the at least one vertical side plate is used for constructing a drawer, a cupboard or a storage box.

6. The combined type shelf of claim 4, wherein each of the two constraint-frame coupling members includes a main coupling plate, a first lateral plate and a second lateral plate, the first lateral plate and the second lateral plate are located to two opposite sides of the main coupling plate and also perpendicular to the main coupling plate so as to form thereinside the locating groove.

7. The combined type shelf of claim 6, wherein each of the constraint-frame coupling members further includes a hanging slot disposed at the second lateral plate.

8. The combined type shelf of claim 1, wherein each of the inter-frame connectors includes an inward protrusion disposed at the connector body by closing to the hole, and the inward protrusion used for supporting the horizontal bar is protruded from a surface of the connector body.

9. The combined type shelf of claim 8, wherein the connector body includes a junction section and two pairing blocks, two opposite sides of the junction section extend outward to connect respectively the two pairing blocks, the inward protrusion and the hole are both disposed at the junction section, and each of the two pairing blocks is used for receiving the first vertical bar and the second vertical bar.

10. The combined type shelf of claim 1, wherein the lower interference part is formed as an interference groove of the lateral plate.

* * * * *